US007767375B2

(12) United States Patent
Kurokawa

(10) Patent No.: US 7,767,375 B2
(45) Date of Patent: Aug. 3, 2010

(54) PRODUCTION PROCESS OF POLYMERIZED TONER

(75) Inventor: Hisashi Kurokawa, Tokyo (JP)

(73) Assignee: Zeon Corporation, Tokyo (JP)

( * ) Notice: Subject to any disclaimer, the term of this patent is extended or adjusted under 35 U.S.C. 154(b) by 910 days.

(21) Appl. No.: 11/628,549

(22) PCT Filed: Jun. 22, 2005

(86) PCT No.: PCT/JP2005/011881

§ 371 (c)(1),
(2), (4) Date: Dec. 5, 2006

(87) PCT Pub. No.: WO2005/122700

PCT Pub. Date: Dec. 29, 2005

(65) Prior Publication Data

US 2007/0243485 A1 Oct. 18, 2007

(30) Foreign Application Priority Data

Jun. 22, 2004 (JP) ..... 2004-183453
Oct. 29, 2004 (JP) ..... 2004-315162

(51) Int. Cl.
*G03G 9/08* (2006.01)

(52) U.S. Cl. ..... 430/137.17; 430/137.15

(58) Field of Classification Search ..... 430/137.15, 430/137.17

See application file for complete search history.

(56) References Cited

U.S. PATENT DOCUMENTS

| | | | | |
|---|---|---|---|---|
| 6,309,788 | B1 | 10/2001 | Tsuji et al. | |
| 6,534,233 | B1 | 3/2003 | Yamamoto et al. | |
| 2005/0048393 | A1 * | 3/2005 | Ota | 430/137.15 |

FOREIGN PATENT DOCUMENTS

| | | | |
|---|---|---|---|
| JP | 5-78607 | A | 3/1993 |
| JP | 6-075429 | | 3/1994 |
| JP | 6-130724 | A | 5/1994 |
| JP | 10-48886 | | 2/1998 |
| JP | 2000-19777 | A | 1/2000 |
| JP | 2000-63694 | A | 2/2000 |
| JP | 2000-089508 | | 3/2000 |
| JP | 3069550 | B2 | 7/2000 |
| JP | 2000-284530 | | 10/2000 |
| JP | 2001-166531 | | 6/2001 |
| JP | 2003-131428 | | 5/2003 |
| JP | 2003-287921 | | 10/2003 |
| JP | 2005-077729 | | 3/2005 |

OTHER PUBLICATIONS

Diamond, A.S., ed., Handbook of Imaging Materials, Marcel Dekker, Inc., NY (1991), pp. 169-170.*

Information Statement submitted by a third party dated Jul. 13, 2009, issued in corresponding Japanese Patent Application No. 2006-514865.

Notification issued by third party mail dated Aug. 19, 2009, issued in corresponding Japanese Patent Application No. 2006-514865.

* cited by examiner

*Primary Examiner*—Janis L Dote
(74) *Attorney, Agent, or Firm*—Westerman, Hattori, Daniels & Adrian, LLP

(57) ABSTRACT

In a process for producing a polymerized toner, comprising Step 1 of preparing a polymerizable monomer composition and Step 2 of polymerizing the polymerizable monomer composition with a polymerization initiator to form colored polymer particles, Step 1 comprises Step A of finely dispersing the colorant in a liquid mixture containing the polymerizable monomer and the colorant, and further Step A comprises Step A1 of feeding a liquid mixture containing a polymerizable monomer and a colorant, which has a volume average particle diameter of 20 μm or larger and/or contains particles having a particle diameter of 51 μm or larger in a volume percentage of 20% or higher, to a dispersing machine of the type that mechanical shearing force is applied by rotation of an agitating blade to preliminarily disperse the colorant, and Step A2 of feeding the liquid mixture containing the colorant preliminarily dispersed in Step A1 to a media type dispersing machine equipped with a media-separating screen to more finely disperse the colorant in the liquid mixture.

20 Claims, 4 Drawing Sheets

(Prior Art)

PRODUCTION PROCESS OF POLYMERIZED TONER

TECHNICAL FIELD

The present invention relates to a production process of a polymerized toner, and more particularly to a production process of a polymerized toner used in development for copying machines, facsimiles, printers and the like by an electrophotographic system.

In the present invention, the polymerized toner means colored resin particles obtained by a polymerization process such as suspension polymerization or emulsion polymerization. The polymerized toner according to the present invention is preferably used as an one-component developer by attaching an external additive functioning as a flowability improver and/or an abrasive thereto. In the description of the present application, the developer may be referred to as "toner" merely.

In the present invention, "a colorant, which has a volume average particle diameter of 20 μm or larger and/or contains particles having a particle diameter of 51 μm or larger in a volume percentage of 20% or higher" means a colorant, which has a volume average particle diameter of 20 μm or larger or contains particles having a particle diameter of 51 μm or larger in a volume percentage of 20% or higher, or a colorant, which has a volume average particle diameter of 20 μm or larger and contains particles having a particle diameter of 51 μm or larger in a volume percentage of 20% or higher.

BACKGROUND ART

In recent years, image forming apparatus using an electrophotographic system, such as copying machines and printers, have rapidly trended toward formation of full-color images. In color printing by the electrophotographic system, even high-definition images including photographs are printed, so that there is a demand for printing high in resolution and good in color reproducibility. Therefore, high-quality color toners, which can meet requirements for such high printability, are required.

In image formation by the electrophotographic system, an electrostatic latent image formed on a photosensitive member is developed with a developer (may referred to as "toner" merely). The developer comprises, as a functional component, colored resin particles. The colored resin particles are roughly divided into a pulverized toner obtained by pulverizing a resin composition comprising a binder resin and a colorant, and a polymerized toner obtained by polymerizing a polymerizable monomer composition comprising a polymerizable monomer and a colorant in an aqueous dispersion medium.

According to the polymerization process, spherical colored resin particles (colored polymer particles) can be efficiently produced. In general, the spherical toner is suitable for use as a color toner because it is good in transferability and dot reproducibility. Therefore, the polymerized toner produced by the polymerization process has been about to be used mainly in the field of developers in recent years. A suspension polymerization process is representative of the polymerization process. Besides this process, a dispersion polymerization process and an emulsion polymerization process are also known.

A one-component developer is obtained by optionally adding an external additive to the colored polymer particles obtained by the polymerization process, and a two-component developer is obtained by mixing carrier particles with the particles. When magnetic powder is contained in a polymerizable monomer to polymerize the monomer, a polymerized toner having magnetism is obtained. Developers (toners) containing the polymerized toner as a functional component are classified into 4 kinds of a magnetic one-component developer, a non-magnetic one-component developer, a magnetic two-component developer and a non-magnetic two-component developer according to the presence of a carrier and magnetic powder.

As colorants, are used black colorants such as carbon black, and besides colorants for color toners, such as yellow colorants, magenta colorants and cyan colorants. Most of these colorants are pigments or dyes substantially insoluble in polymerizable monomers.

In order to form a high-definition image using the polymerized toner, it is required to finely and uniformly disperse the colorant in the polymerized toner. Therefore, in a process for the production of the polymerized toner, it is first necessary to finely disperse the colorant in a polymerizable monomer. There have heretofore been proposed methods using various kinds of media dispersing machines as methods for dispersing the colorant in the polymerizable monomer.

For example, Japanese Patent Application Laid-Open No. 6-75429 has proposed a production process of a polymerized toner making use of a media dispersing machine shown in FIG. 5 in the step of dispersing a colorant in a polymerizable monomer.

The media dispersing machine shown in FIG. 5 has a structure that a plurality of agitator discs (i.e., "rotors") 507 fitted on a driving shaft 510 are arranged within a cylindrical casing (i.e., "stator") 501 having a liquid supply port 502, and a great number of media particles 508 are contained in an internal space. A jacket having a cooling medium inlet 504 and a cooling medium outlet 505 is arranged on an external peripheral surface of the cylindrical casing 501 in such a manner that the internal temperature of the casing can be controlled by a cooling medium.

When a liquid mixture (slurry) containing at least a polymerizable monomer and a colorant is continuously introduced into the casing from the liquid supply port 502 while rotating the agitator discs 507 by rotation of the driving shaft 510, strong shearing force is applied to the media particles and the liquid mixture, and the colorant is pulverized in the liquid mixture and finely dispersed therein. The liquid mixture (i.e., "dispersion liquid") with the colorant finely dispersed is separated from the media particles by a media-separating gap separator 509 and carried to the outside from a liquid discharge port 503 provided at an upper portion of the casing 501.

Since the media dispersing machine shown in FIG. 5 is wide in the internal space, a packing phenomenon that the media particles filled are forcedly pressed against the inner surface of the casing by the centrifugal force of the agitator discs is markedly caused when the peripheral velocity of the tip of the agitator disc is increased for raising the ability to pulverize the colorant, so that the layer of the media particles filled becomes uneven. As a result, the so-called short pass that the flow of the liquid mixture is liable to pass through a thin portion of the media particle layer has occurred to involve a problem that the efficiency of pulverization•dispersion and evenness are lowered.

In addition to the above problem, this media dispersing machine has involved a problem that since the media particles are unevenly distributed to the media separation gap separator portion, and the efficiency of dispersion is lowered, it takes a long time for treatment, and moreover a production efficiency is greatly lowered because the treatment speed is lowered by the pressure increase within the apparatus. In fact, Examples of Japanese Patent Application Laid-Open No. 6-75429 only show experimental examples where the media dispersing machine is used to conduct dispersion with the peripheral velocity of the agitator (stator) agitating the media controlled to a fixed peripheral velocity within a range of 3 to 30 m/s. According to such a method, the degree of dispersion of the colorant becomes insufficient, or the treatment time becomes long to greatly lower a production efficiency.

U.S. Pat. No. 6,309,788 has proposed a method for dispersing a colorant in a polymerizable monomer by using a media particle agitating type wet dispersing machine, in the internal chamber of which a plurality of media particles are contained. Even when this method is used, however, there have been problems that the degree of dispersion of the colorant becomes insufficient, and that the media particles are unevenly distributed on to a slit of a separator to raise the internal pressure of the apparatus, and so a production efficiency is lowered.

Japanese Patent Application Laid-Open No. 2000-89508 discloses, as a means for dispersing a colorant in a polymerizable monomer, a method in which the colorant is pre-dispersed in the polymerizable monomer for 10 to 60 minutes under high-speed agitation at a peripheral velocity of 1.5 to 12 m/s, and dispersion is then conducted by a batch type dispersion machine using media. According to this method, however, sufficient dispersion cannot be achieved, or it takes a too long time to reach a sufficiently dispersed level.

U.S. Pat. No. 6,534,233 has proposed a method for dispersing a colorant by means of a media dispersing machine under conditions that the tip speed (peripheral velocity) of an agitator (rotor) is 3 to 20 m/s, and a residence time is 0.03 to 0.5 hour. Even by this method, a necessary dispersed level cannot be attained in the case of a color toner of which a particularly high dispersed level is required, or it takes a very long time to reach the dispersed level, so that productivity is deteriorated.

DISCLOSURE OF THE INVENTION

It is an object of the present invention to provide a process for stably and efficiently producing a polymerized toner in which a colorant is uniformly and extremely finely dispersed, and which is excellent in printing density and color tone.

In particular, it is an object of the present invention to provide a process for producing a polymerized toner, which comprises a dispersion step of uniformly and extremely finely dispersing a colorant in a polymerizable monomer.

In order to solve the above-described problems, OTA, Nobuyasu, who is a researcher of the present applicant (ZEON CORPORATION), found that a media dispersing machine of a structure having a media-separating screen is suitable for use in finely dispersing a colorant in a polymerizable monomer as a dispersing machine (Japanese Patent Application No. 2003-307804, filed Aug. 29, 2003; Japanese Patent Application Laid-Open No. 2005-77729, US2005/0048393A1). In the media dispersing machine having the media-separating screen, media particles having a small particle diameter can be used, so that a colorant can be extremely finely dispersed. More specifically, when a liquid mixture containing a polymerizable monomer and a colorant is subjected to a dispersing treatment by means of the media dispersing machine, the degree of dispersion of the colorant can be controlled in such a manner that when a coating film formed with a polymerizable monomer dispersion liquid with the colorant finely dispersed at a concentration of 3% by weight is observed through a light microscope of 400 magnifications, the number of colorant particles having a length exceeding 0.5 μm, which are contained in a visual field of a 100 μm square in the coating film, is preferably at most 5, often 0.

In other words, when the media dispersing machine is used to conduct a dispersing treatment, a polymerizable monomer dispersion liquid containing a colorant extremely finely dispersed can be provided. When other additive components than the colorant, such as a charge control agent, are dissolved or dispersed in the dispersion liquid, a polymerizable monomer composition can be provided. When this polymerizable monomer composition is polymerized, a polymerized toner, in which the colorant is uniformly and finely dispersed, can be provided.

However, it has been found that when the particle diameter of a colorant used as a starting material is large, or the content of coarse particles contained therein is high, the above-described media dispersing machine having the media-separating screen gradually causes clogging with the colorant at the media-separating screen, and consequently, a treatment speed is lowered, and in an extraordinary case, the dispersing treatment becomes entirely impossible.

Among commercially available colorants for color toners, are included those large in particle diameter, which have a volume average particle diameter of 20 μm or larger and/or contain particles having a particle diameter of 51 μm or larger in a volume percentage of 20% or higher, or those containing coarse particles in a high proportion.

The present inventor has carried out an extensive investigation with a view toward achieving the above objects. As a result, it has been found that when the particle diameter of a colorant used in a dispersing treatment is large, and/or the content of coarse particles contained therein is high, a preliminary dispersion step is arranged prior to a dispersion step using the above-described specific media dispersing machine, whereby the above-described problems can be solved. This may be referred to as a first invention of the present application.

Further, the present inventor has found that when a liquid mixture containing a polymerizable monomer and a colorant is subjected to a dispersing treatment by means of the media dispersing machine, the dispersing treatment is conducted while circulating the dispersion liquid in the media dispersing machine, and the residence time in the media dispersing machine is varied so as to satisfy specific conditions, whereby the dispersing treatment can be efficiently conducted, and in turn a polymerized toner, which can provide high-quality images, can be obtained. This may be referred to as a second invention of the present application.

The present invention has been led to completion on the basis of these findings.

According to the present invention, there is provided a process for producing a polymerized toner, comprising Step 1 of preparing a polymerizable monomer composition containing a polymerizable monomer and a colorant and Step 2 of polymerizing the polymerizable monomer composition with a polymerization initiator to form colored polymer particles, wherein, Step 1 comprises Step A of finely dispersing the colorant in a liquid mixture containing the polymerizable monomer and the colorant, and further wherein Step A comprises the following Steps A1 and A2:

(1) Step A1 of feeding a liquid mixture containing a polymerizable monomer and a colorant, which has a volume average particle diameter of 20 μm or larger and/or contains particles having a particle diameter of 51 μm or larger in a volume percentage of 20% or higher, to a dispersing machine by which mechanical shearing force is applied by rotation of an agitating blade to preliminarily disperse the colorant in such a manner that the volume average particle diameter of the colorant becomes smaller than 20 μm, and the volume percentage of the particles having a particle diameter of 51 μm or larger becomes lower than 20%; and (2) Step A2 of feeding the liquid mixture containing the polymerizable monomer and the colorant and preliminarily dispersed in Step A1 to a media dispersing machine equipped with a media-separating screen to more finely disperse the colorant in the liquid mixture, thereby preparing a polymerizable monomer dispersion liquid.

According to the present invention, there is also provided a process for producing a polymerized toner, comprising Step 1 of preparing a polymerizable monomer composition containing a polymerizable monomer and a colorant and Step 2 of polymerizing the polymerizable monomer composition with a polymerization initiator to form colored polymer particles, wherein, Step 1 comprises a dispersion step of finely dispersing the colorant in a liquid mixture containing the polymerizable monomer and the colorant, and further wherein in the dispersion step, a liquid mixture containing a polymerizable monomer and a colorant, which has a volume average particle diameter smaller than 20 μm, and in which the volume percentage of particles having a particle diameter of 51 μm or larger is lower than 20%, is poured into a holding tank joined to a media dispersing machine through a circulation line, and the liquid mixture is continuously fed to the media dispersing machine from the holding tank to circulate the liquid mixture in the media dispersing machine, thereby finely dispersing the colorant in the liquid mixture, and at this time, the amount of the liquid mixture fed to the media dispersing machine is controlled in such a manner that an average residence time $\tau 1$ within the media dispersing machine from the beginning of the dispersion step by the media dispersing machine to a half of the number of circulations in the whole dispersion step and an average residence time $\tau 2$ within the media dispersing machine from the half of the number of circulations in the whole dispersion step to the end of the whole dispersion step satisfy the relationship of $\tau 1/\tau 2>1.05$.

BEST MODE FOR CARRYING OUT THE INVENTION

Figure 1:
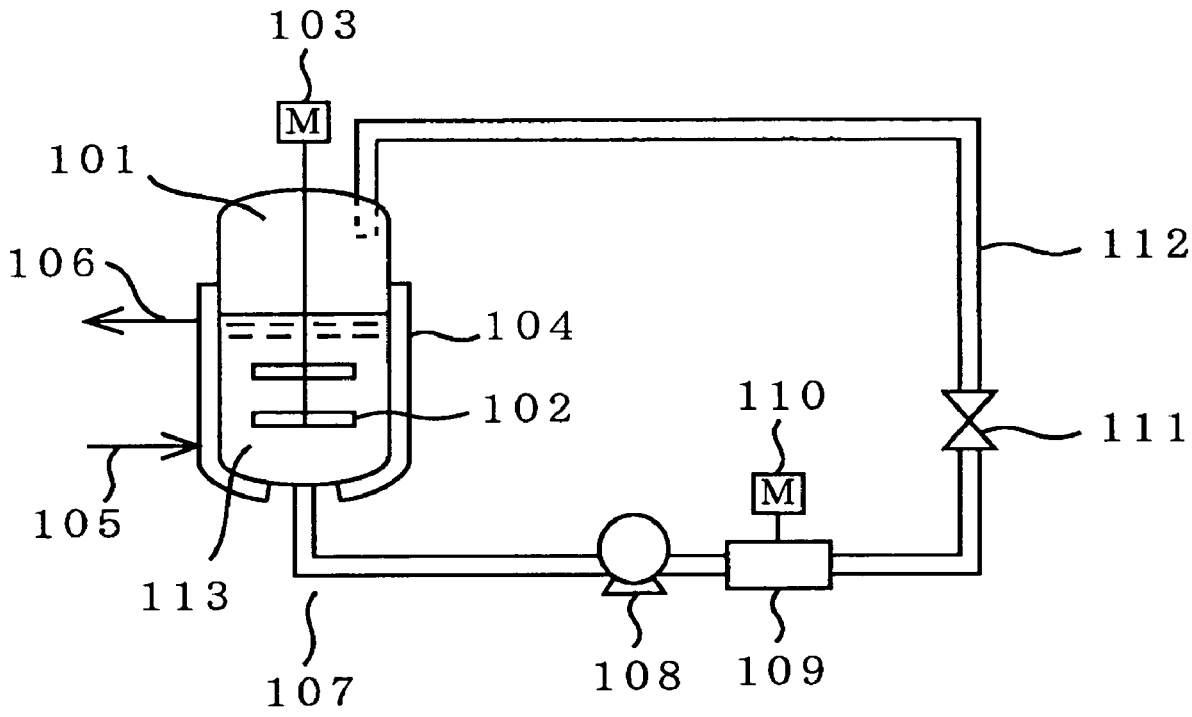
FIG. 1 illustrates a preliminary dispersion system adopted in Examples of the present invention.

1. Preparation Step 1 of Polymerizable Monomer Composition

The process according to the present invention for producing a polymerized toner comprises Step 1 of preparing a polymerizable monomer composition containing at least a polymerizable monomer and a colorant and Step 2 of polymerizing the polymerizable monomer composition with a polymerization initiator to form colored polymer particles (polymerized toner). In Step 2, a process, in which the polymerizable monomer composition is suspended or emulsified in an aqueous dispersion medium to conduct polymerization, is generally adopted.

Step 1 comprises a dispersion step of finely dispersing the colorant in a liquid mixture containing at least the polymerizable monomer and the colorant. The dispersion step is a step of finely dispersing the colorant in the polymerizable monomer.

In the present invention, when the particle diameter of a colorant used as a starting material is large, or the content of coarse particles contained therein is high, the dispersion step comprises Step A1 of feeding a liquid mixture containing a polymerizable monomer and a colorant, which has a volume average particle diameter of 20 μm or larger and/or contains particles having a particle diameter of 51 μm or larger in a volume percentage of 20% or higher, to a dispersing machine by which mechanical shearing force is applied by rotation of an agitating blade to finely and preliminarily disperse the colorant in the dispersion liquid. In the present invention, the dispersion step comprises Step A2 of feeding the liquid mixture containing the colorant preliminarily dispersed after Step A1 to a media dispersing machine equipped with a media-separating screen to more finely disperse the colorant in the liquid mixture.

In the present invention, when a colorant, which has a volume average particle diameter smaller than 20 μm, and in which the volume percentage of particles having a particle diameter of 51 μm or larger is lower than 20%, is used as the colorant, a dispersion liquid containing a polymerizable monomer and the colorant is subjected to a dispersing treatment by means of a media dispersing machine, and at this time, the dispersing treatment is conducted while circulating the dispersion liquid in the media dispersing machine, and the residence time in the media dispersing machine is varied so as to satisfy specific conditions, whereby the dispersing treatment is efficiently conducted. Even in this case, such a preliminary dispersion step as described above is preferably arranged when a colorant having a large particle diameter or containing coarse particles in a high proportion is used.

The dispersion step of the present invention comprises a step of feeding the liquid mixture containing the polymerizable monomer and the colorant to the media dispersing machine to prepare a polymerizable monomer dispersion liquid with the colorant finely dispersed. When the dispersion step comprises the preliminary dispersion step, the liquid mixture is fed to the dispersing machine by which mechanical shearing force is applied by rotation of an agitating blade to finely and preliminarily disperse the colorant in the dispersion liquid.

Into the liquid mixture of the raw material, other additive components than the colorant, such as a parting agent and a charge control agent, may also be added as needed. In order to raise a dispersing efficiency, it is preferable that a liquid mixture substantially containing only the polymerizable monomer and the colorant be used to prepare a polymerizable monomer dispersion liquid with the colorant finely dispersed by the dispersion step, and the other additive components than the colorant be then dispersed or dissolved in the resultant polymerizable monomer dispersion liquid to prepare a polymerizable monomer composition. Part of the other additive components than the colorant may also be added to an aqueous dispersion medium upon the formation of droplets of the polymerizable monomer composition in the aqueous dispersion medium to cause them to migrate into the droplets.

Accordingly, Preparation Step 1 of the polymerizable monomer composition according to the present invention includes a case where the polymerizable monomer composition is prepared by only the above-described dispersion step and a case where the polymerizable monomer composition is prepared by the dispersion step and the step of optionally adding the other additive components than the colorant to the polymerizable monomer dispersion liquid obtained in the dispersion step.

In the present invention, a raw mixture containing the polymerizable monomer and the colorant, which is first poured into the dispersing machine for preliminary dispersion or the media dispersing machine, is referred to as "a liquid mixture" (slurry), and a mixture with the colorant finely dispersed by the media dispersing machine is referred to as "a polymerizable monomer dispersion liquid" or merely "a dispersion liquid".

The other additive components than the colorant are optionally added to this polymerizable monomer dispersion liquid to prepare a polymerizable monomer composition. This polymerizable monomer composition is emulsified or suspended in an aqueous dispersion medium to conduct polymerization in the presence of a polymerization initiator, thereby preparing an aqueous dispersion containing colored polymer particles. This aqueous dispersion was washed, dehydrated and dried, and optionally classified to obtain a polymerized toner. As needed, an external additive and/or a carrier is added to the polymerized toner to provide a developer (toner).

By the above-described preliminary dispersion step and dispersion step, the colorant is finely dispersed in the polymerizable monomer. In the present invention, the colorant through the preliminary dispersion step and the colorant through the dispersion step may be referred to as "preliminarily dispersed colorant" and "dispersed colorant", respectively.

The polymerizable monomer composition contains the polymerizable monomer and the colorant. However, the polymerizable monomer composition may contain various kinds of additives such as a charge control agent, a parting agent, a molecular weight modifier and a dispersion aid as needed. Since the polymerizable monomer composition is polymerized in the presence of the polymerization initiator, the polymerization initiator is contained prior to the initiation of polymerization.

(1) Polymerizable Monomer

In the present invention, a monovinyl monomer is used as a main component of the polymerizable monomer. Examples thereof include aromatic vinyl monomers such as styrene, vinyltoluene and α-methylstyrene; acrylic acid and methacrylic acid; acrylic acid derivatives such as methyl acrylate, ethyl acrylate, propyl acrylate, butyl acrylate, 2-ethylhexyl acrylate, cyclohexyl acrylate, isobonyl acrylate, dimethylaminoethyl acrylate and acrylamide; methacrylic acid derivatives such as methyl methacrylate, ethyl methacrylate, propyl methacrylate, butyl methacrylate, 2-ethylhexyl methacrylate, cyclohexyl methacrylate, isobonyl methacrylate, dimethylaminoethyl methacrylate and methacrylamide; monoolefin monomers such as ethylene, propylene and butylene; vinyl halides and vinylidene halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone.

The monovinyl monomers may be used either singly or in any combination thereof. Of these monovinyl monomers, styrene, a styrene derivative, acrylic acid or acrylic acid derivative, or a combination of two or more thereof is preferably used.

The monovinyl monomer(s) may preferably be selected in such a manner that the glass transition temperature Tg of a polymer obtained by polymerizing them is 80° C. or lower.

The monovinyl monomers are used singly or in combination of two or more thereof, whereby the Tg of a polymer to be formed can be controlled within a desired range.

When a crosslinkable monomer is used together with the monovinyl monomer, the hot offset property of the resulting toner can be improved. The crosslinkable monomer means a monomer having at least two polymerizable functional groups. As examples of the crosslinkable monomer, may be mentioned aromatic divinyl compounds such as divinylbenzene, divinylnaphthalene and derivatives thereof; unsaturated carboxylic acid polyesters of polyhydric alcohols, such as ethylene glycol dimethacrylate and diethylene glycol dimethacrylate; other divinyl compounds such as N,N-divinylaniline and divinyl ether; and compounds having three or more vinyl groups. These crosslinkable monomers may be used either singly or in any combination thereof. The proportion of the crosslinkable monomer used is generally at most 10 parts by weight, preferably from 0.01 to 7 parts by weight, more preferably from 0.05 to 5 parts by weight per 100 parts by weight of the monovinyl monomer.

It is preferable to use a macromonomer together with the monovinyl monomer because a balance between the high-temperature storage stability and the low-temperature fixing ability of the resulting polymerized toner can be improved. The macromonomer is a macromolecule having a polymerizable carbon-carbon unsaturated double bond at its molecular chain terminal and is an oligomer or polymer having a number average molecular weight of generally from 1,000 to 30,000. When the number average molecular weight falls within the above range, the fixing ability and storage stability of the resulting polymerized toner can be retained without impairing the melt properties of the macromonomer. Thus, the macromonomer preferably has a number average molecular weight within the above range.

As examples of the polymerizable carbon-carbon unsaturated double bond that the macromonomer has at its molecular chain terminal, may be mentioned an acryloyl group and a methacryloyl group. Among these, the methacryloyl group is preferred from the viewpoint of easy copolymerization. The macromonomer is preferably that capable of providing a polymer having a glass transition temperature higher than that of a polymer obtained by polymerizing the monovinyl monomer.

As specific examples of the macromonomer, may be mentioned polymers obtained by polymerizing styrene, styrene derivatives, methacrylic esters, acrylic esters, acrylonitrile and methacrylonitrile either singly or in combination of two or more monomers thereof; and macromonomers having a polysiloxane skeleton. Among these, hydrophilic macromonomers are preferred, with macromonomers composed of a polymer obtained by polymerizing a methacrylic ester or an acrylic ester by itself or in combination thereof being particularly preferred.

When the macromonomer is used, the used amount thereof is generally from 0.01 to 10 parts by weight, preferably from 0.03 to 5 parts by weight, more preferably 0.05 to 1 part by weight per 100 parts by weight of the monovinyl monomer. When the proportion of the macromonomer used falls within the above range, the fixing ability of the resulting polymerized toner is improved while retaining its storage stability. Thus, the macromonomer is preferably used in the proportion within the above range.

(2) Colorant

As the colorant, may be used any of various kinds of pigments and dyes used in the field of toners, such as carbon black and titanium white. As examples of black colorants, may be mentioned dyes and pigments such as carbon black and Nigrosine Base; and magnetic powders such as cobalt, nickel, triiron tetroxide, manganese iron oxide, zinc iron oxide and nickel iron oxide. When carbon black is used, that having a primary particle diameter of from 20 to 40 nm is preferably used in that the resulting toner can provide images good in image quality, and the safety of the toner in environment is enhanced.

As colorants for color toners, yellow colorants, magenta colorants and cyan colorants may be generally used in addition to the above-mentioned black colorants.

As the yellow colorants, may be used, for example, fused azo compounds, isoindolinone compounds, anthraquinone compounds, azo metallic complexes, methine compounds and allylamide compounds. Specific examples thereof include C.I. Pigment Yellow 3, 12, 13, 14, 15, 17, 62, 65, 73, 74, 83, 90, 93, 95, 96, 97, 109, 110, 120, 128, 129, 138, 147, 155, 168, 180, 181, 185 and 186. Besides the above, Naphthol Yellow S, Hansa Yellow G and C.I. Vat Yellow are mentioned as yellow colorants.

Examples of the magenta colorants include fused azo compounds, diketopyrrolopyrrole compounds, anthraquinone compounds, quinacridone compounds, basic dye lake compounds, naphthol compounds, benzimidazole compounds, thioindigo compounds and perillene compounds. Specific examples thereof include C.I. Pigment Red 2, 3, 5, 6, 7, 23, 31, 48, 48:2, 48:3, 48:4, 57, 57:1, 58, 60, 63, 64, 68, 81, 81:1, 83, 87, 88, 89, 90, 112, 114, 122, 123, 144, 146, 149, 150, 163, 166, 169, 170, 177, 184, 185, 187, 202, 206, 207, 209, 251 and 254. Besides the above, for example, C.I. Pigment Violet 19 is mentioned as a magenta colorant.

Examples of the cyan colorants include copper phthalocyanine compounds and derivatives thereof, anthraquinone compounds, and basic dye lake compounds. Specific examples thereof include C.I. Pigment Blue 1, 2, 3, 6, 7, 15, 15:1, 15:2, 15:3, 15:4, 16, 17, 60, 62 and 66. Besides the above, for example, Phthalocyanine Blue, C.I. Vat Blue and C.I. Acid Blue are mentioned as cyan colorants.

These colorants may be used either singly or in combination of two or more compounds thereof. The colorant is used in a proportion of generally from 0.1 to 70 parts by weight, preferably from 0.5 to 50 parts by weight, more preferably from 1 to 10 parts by weight per 100 parts by weight of the polymerizable monomer.

(3) Charge Control Agent

In order to improve the charge properties of the resulting polymerized toner, various kinds of charge control agents having positively charging ability or negatively charging ability are preferably contained in the polymerizable monomer composition. Examples of the charge control agents include metal complexes of organic compounds having a carboxyl group or a nitrogen-containing group, metallized dyes, nigrosine and charge control resins.

In the present invention, a charge control resin is preferably used. Examples of a negative charge control resin include resins having, on side chains of their polymers, a substituent group selected from i) a carboxyl group or a salt thereof, ii) a phenyl group or a salt thereof, iii) a thiophenyl group or a salt thereof and iv) a sulfonic group or a salt thereof.

The weight average molecular weight of the charge control resin is generally from 2,000 to 30,000, preferably from 4,000 to 25,000, more preferably from 6,000 to 20,000.

The charge control agent is used in a proportion of generally from 0.01 to 10 parts by weight, preferably from 0.1 to 10 parts by weight per 100 parts by weight of the polymerizable monomer.

(4) Parting Agent

In order to, for example, prevent offset and improve the parting ability of the resulting polymerized toner upon fixing by a heated roll, any of various kinds of parting agents used in the technical field of toners may be contained in the polymerizable monomer composition.

Examples of the parting agent include low-molecular weight polyolefin waxes such as low-molecular weight polyethylene, low-molecular weight polypropylene and low-molecular weight polybutylene; terminal-modified polyolefin waxes such as molecule terminal-oxidized low-molecular weight polypropylene, terminal-modified low-molecular weight polypropylene with its molecular terminal substituted by an epoxy group and block polymers of these compounds with low-molecular weight polyethylene, and molecule terminal-oxidized low-molecular weight polyethylene, low-molecular weight polyethylene with its molecular terminal substituted by an epoxy group and block polymers of these compounds with low-molecular weight polypropylene; vegetable natural waxes such as candelilla wax, carnauba wax, rice wax, Japan wax and jojoba wax; petroleum waxes such as paraffin wax, microcrystalline wax and petrolatum, and modified waxes thereof; mineral waxes such as montan, ceresin and ozokerite; synthetic waxes such as Fischer-Tropsch wax; pentaerythritol esters such as pentaerythritol tetramyristate, pentaerythritol tetrapalmitate, pentaerythritol tetrastearate and pentaerythritol tetralaurate; and dipentaerythritol esters such as dipentaerythritol hexamyristate, dipentaerythritol hexapalmitate and dipentaerythritol hexylaurate. These parting agents may be used either singly or in any combination thereof.

Among these parting agents, polyvalent ester compounds such as pentaerythritol esters, whose endothermic peak temperatures fall within a range of generally from 30 to 150° C., preferably from 50 to 120° C., more preferably from 60 to 100° C. as determined from a DSC curve upon heating thereof by a differential scanning calorimeter, and dipentaerythritol esters, whose endothermic peak temperatures fall within a range of from 50 to 80° C. as determined likewise, are particularly preferred from the viewpoint of a balance between the fixing ability and the parting ability of the resulting toner.

The proportion of the parting agent used is generally from 0.1 to 50 parts by weight, preferably from 0.5 to 20 parts by weight, more preferably from 1 to 10 parts by weight per 100 parts by weight of the polymerizable monomer.

(5) Polymerization Initiator

As examples of the polymerization initiator for the polymerizable monomer, may be mentioned persulfates such as potassium persulfate and ammonium persulfate; azo compounds such as 4,4'-azobis(4-cyanovaleric acid), 2,2'-azobis[2-methyl-N-(2-hydroxyethyl)propionamide], 2,2'-azobis(2-amidinopropane) dihydrochloride, 2,2'-azobis(2,4-dimethylvaleronitrile) and 2,2'-azobisisobutyronitrile; and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxypivalate, di-isopropyl peroxydicarbonate, di-t-butyl peroxyisophthalate, 1,1',3,3'-tetramethylbutyl peroxy-2-ethylhexanoate and t-butyl peroxyisobutyrate. Redox initiators obtained by combining these polymerization initiators with a reducing agent may also be used.

Among these polymerization initiators, an oil-soluble polymerization initiator, which is soluble in the polymerizable monomer, is preferably selected, and a water-soluble polymerization initiator may also be used in combination with the oil-soluble initiator as needed.

The polymerization initiator is used in a proportion of generally from 0.1 to 20 parts by weight, preferably from 0.3 to 15 parts by weight, more preferably from 0.5 to 10 parts by weight per 100 parts by weight of the polymerizable monomer.

The polymerization initiator may be added into the polymerizable monomer composition in advance. In order to avoid premature polymerization, however, the polymerization initiator is preferably added directly into the suspension in the middle or after completion of the step of forming droplets of the polymerizable monomer composition, or in the middle of a polymerization reaction.

(6) Molecular Weight Modifier

A molecular weight modifier is preferably used upon the polymerization. As examples of the molecular weight modifier, may be mentioned mercaptans such as t-dodecyl-mercaptan, n-dodecylmercaptan, n-octylmercaptan and 2,2,4,6,6-pentamethylheptane-4-thiol; and halogenated hydrocarbons such as carbon tetrachloride and carbon tetrabromide. The molecular weight modifier is generally contained in the polymerizable monomer composition prior to the initiation of the polymerization. However, it may also be added in the middle of the polymerization.

The molecular weight modifier is used in a proportion of generally from 0.01 to 10 parts by weight, preferably from 0.1 to 5 parts by weight per 100 parts by weight of the polymerizable monomer.

When a dispersion liquid composed of the polymerizable monomer and the colorant is prepared in the dispersion step in Preparation Step 1 of the polymerizable monomer composition, other additive components than the colorant may be added to the dispersion liquid after the dispersion step as needed. In this case, the other additive components than the colorant may be poured into the dispersion liquid and dissolved or dispersed therein. Part of the additive components may be added to an aqueous dispersion medium in the step of pouring the polymerizable monomer composition into the aqueous dispersion medium to form droplets, thereby causing them to be absorbed in the droplets to contain them in the polymerizable monomer composition.

2. Preliminary Dispersion Step

The preliminary dispersion step in Preparation Step 1 of the polymerizable monomer composition will hereinafter be described. When a colorant having a large particle diameter or containing coarse particles in a high proportion in the present invention, a preliminary dispersion step is arranged to preliminarily finely disperse the colorant in the polymerizable monomer, and the resultant polymerizable monomer liquid mixture preliminarily dispersed is then fed to a media dispersing machine to more finely disperse the colorant. The preliminary dispersion step is arranged, whereby the fine and uniform dispersion of the colorant in the dispersion step using the media dispersing machine can be efficiently conducted without clogging the media-separating screen.

The production process according to the present invention for producing a polymerized toner comprises Step 1 of preparing a polymerizable monomer composition containing a polymerizable monomer and a colorant. The first invention of the present application comprises Step A for finely dispersing the colorant in a liquid mixture containing the polymerizable monomer and the colorant, and Step A additionally comprises the following Steps A1 and A2. Even in the second invention of the present application, it is preferable to finely and preliminarily disperse the colorant by the preliminary dispersion step when a colorant having a large particle diameter or containing coarse particles in a high proportion is used.

Step A1 is a step of feeding a liquid mixture containing a polymerizable monomer and a colorant, which has a volume average particle diameter of 20 μm or larger and/or contains particles having a particle diameter of 51 μm or larger in a volume percentage of 20% or higher, to a dispersing machine by which mechanical shearing force is applied by rotation of an agitating blade to finely and preliminarily disperse the colorant in the dispersion liquid.

Step A2 is a step of feeding the liquid mixture containing the colorant preliminarily dispersed in Step A1 to a media dispersing machine equipped with a media-separating screen to more finely disperse the colorant in the liquid mixture.

The volume average particle diameter Dv of the colorant used as a starting material is generally 20 μm or larger, often from 20 to 150 μm, more often from 30 to 100 μm. The volume percentage D51 of particles having a particle diameter of 51 μm or larger contained in the colorant used as a starting material is generally 20% or higher, often from 20 to 95%, more often from 30 to 85%. When such a colorant having a large particle diameter or containing coarse particles in a high proportion is dispersed by means of the media dispersing machine equipped with the media-separating screen, the media-separating screen tends to cause clogging, and so it is difficult to finely disperse the colorant.

In the present invention, the liquid mixture containing the polymerizable monomer and the colorant is thus fed to the dispersing machine by which mechanical shearing force is applied by rotation of an agitating blade to finely and preliminarily disperse the colorant in the liquid mixture. In the preliminary dispersion step A1, the colorant is preliminarily dispersed in the liquid mixture in such a manner that the volume average particle diameter of the colorant becomes smaller than 20 μm, and the volume percentage of the particles having a particle diameter of 51 μm or larger becomes lower than 20%. In the preliminary dispersion step A1, it is desirable that the colorant is preliminarily dispersed until the volume average particle diameter Dv of the colorant is preferably 19 μm or smaller, more preferably 18 μm or smaller, particularly preferably 15 μm or smaller. The lower limit of the volume average particle diameter Dv of the colorant preliminarily dispersed is preferably 1 μm, more preferably 2 μm, particularly preferably 3 μm, often 5 μm.

Unless the colorant is preliminarily dispersed in the preliminary dispersion step A1 until the volume average particle diameter Dv of the colorant is fully small, the media-separating screen tends to cause clogging. Unless the volume average particle diameter of the colorant preliminarily dispersed is fully small, the media dispersing machine shows a tendency to lower a dispersing efficiency. On the other hand, if the colorant is dispersed in the preliminary dispersion step A1 until the volume average particle diameter Dv thereof is excessively small, it takes a long time to conduct the whole dispersing treatment, so that the dispersing efficiency is lowered. The volume average particle diameter Dv of the colorant preliminarily dispersed is preferably from 1 to 19 μm, more preferably from 3 to 18 μm, still more preferably from 5 to 15 μm. In many cases, the volume average particle diameter is particularly preferably from 7 to 13 μm.

In the preliminary dispersion step A1, it is desirable that the colorant is preliminarily dispersed until the volume percentage D51 of particles having a particle diameter of 51 μm or larger contained in the colorant is preferably 19% or lower, more preferably 18% or lower, particularly preferably 15% or lower. The lower limit of the D51 of the colorant preliminarily dispersed is preferably 1%, more preferably 2%, still more preferably 3%, and often 5%. Unless the colorant is preliminarily dispersed until the D51 of the colorant is sufficiently low, the media-separating screen tends to cause clogging. Unless the D1 of the colorant preliminarily dispersed is fully low, the media dispersing machine shows a tendency to lower a dispersing efficiency. On the other hand, if the colorant is dispersed in the preliminary dispersion step A1 until the D51 thereof is excessively low, it takes a long time to conduct the whole dispersing treatment, so that the dispersing efficiency is lowered. The D51 of the colorant preliminarily dispersed is preferably from 1 to 19%, more preferably from 3 to 18%, still more preferably from 5 to 15%. In many cases, the D51 is particularly preferably from 7 to 13%.

If the D51 is 20% or higher even when the volume average particle diameter Dv of the colorant preliminarily dispersed is smaller than 20 μm, further not larger than 15 μm, it is difficult to efficiently disperse the colorant even by means of the media dispersing machine. Accordingly, it is necessary to make both Dv and D51 of the colorant small in the preliminary dispersion step A1.

In the preliminary dispersion step A1 and the dispersion step A2 using the media dispersing machine, a pigment dispersant is preferably used for the purpose of stabilizing the dispersed state of the colorant. As the pigment dispersant, is preferred a coupling agent such as an aluminum coupling agent, silane coupling agent or titanium coupling agent. The pigment dispersant is used in a proportion of generally from 0.05 to 3 parts by weight, preferably from 0.2 to 2 parts by weight per 100 parts by weight of the polymerizable monomer. In order to efficiently conduct uniform dispersion, it is preferable to add the pigment dispersant prior to the preliminary dispersion step A1 or prior to the dispersion step A2. It is more preferable to add it prior to the preliminary dispersion step A1.

In the preliminary dispersion step, a polymerizable monomer liquid mixture containing the polymerizable monomer, the colorant and the other additives optionally added is preliminarily dispersed to prepare a preliminarily dispersed polymerizable monomer liquid mixture.

In the preliminary dispersion step A1, any of pre-dispersing machines exemplified below is used. An exemplary preliminary dispersion system is illustrated in FIG. 1. The preliminary dispersion system is a system comprising a holding tank 101, into which the polymerizable monomer liquid mixture is poured, a dispersing machine (hereinafter referred to as "pre-dispersing machine") 109, a circulation line 107 for circulating the polymerizable monomer liquid mixture between the holding tank 101 and the pre-dispersing machine 109, and a valve 111 arranged in a circulation line 112 between a discharge side of the pre-dispersing machine 109 and the holding tank 101.

Agitating blades 102 driven and rotated by an agitating motor 103 is arranged in the holding tank 101. A jacket 104 is fitted to an outer wall of the holding tank 101 in such a manner that the temperature of the liquid in the holding tank 101 can be controlled by introducing a temperature control medium into the jacket from an inlet 105 for the temperature control medium and discharging the medium from an outlet 106 for the temperature control medium.

The liquid mixture 113 containing the polymerizable monomer and the colorant is poured into the holding tank 101. The liquid mixture is fed to the pre-dispersing machine 109 through the circulation line 107 by a pump 108. In the pre-dispersing machine, an agitating blade is driven by a motor 110. The liquid mixture preliminarily dispersed by the pre-dispersing machine is circulated to the original holding tank 101 through the circulation line 112, in which the valve 111 is arranged.

In the present invention, mechanical shearing force is applied to the colorant in the polymerizable monomer liquid mixture in the preliminary dispersion step A1 to preliminarily disperse the colorant. As the pre-dispersing machine, is preferably an agitating device having high shearing force. In general, no particular limitation is imposed on the machine so far as it is a device that the polymerizable monomer liquid mixture is taken in a treating part, and an agitating blade arranged in the treating part is rotated at a high speed to disperse the colorant. No particular limitation is also imposed on the shape and structure of the agitating blade (rotor) so far as high shearing force can be applied to the liquid mixture.

Examples of such a agitating device include:

(a) agitating devices typified by EBARA MILDER (manufactured by Ebara Corporation, trade name), CAVITRON (manufactured by EUROTEC, LTD, trade name) and DRS2000 (manufactured by IKA Co.), i.e., agitating devices equipped with a comb teeth-like rotor and a stator, which are concentrically arranged, wherein the rotor is rotated at a high speed, and a liquid mixture to be agitated is passed through from the internal side of the rotor to the external side of the stator to agitate the liquid mixture in a space between the rotor and the stator;

(b) agitating devices typified by CLEARMIX CLM-0.8S (manufactured by M-TECHNIQUE Co., Ltd., trade name), i.e., devices that agitation is conducted by action of shearing force, impact force, pressure change, cavitation and potential core caused between a rotor, which is rotated at a high speed, and a screen surrounding it;

(c) turbine type agitating machines typified by TK HOMOMIXER (manufactured by Tokushu Kika Kogyo Co., Ltd., trade name); and (d) agitating devices typified by TK FILMIX (manufactured by Tokushu Kika Kogyo Co., Ltd., trademark), i.e., devices that a liquid mixture to be treated is pressed against a side wall of a dispersing chamber by centrifugal force to form a liquid film, and the tip of an agitator (rotor) rotating at an ultra-high speed is brought into contact with the liquid film, thereby conducting agitation.

The residence time in the pre-dispersing machine can be calculated out in accordance with the following equation.

Residence time (min)=[Space volume (L) of the pre-dispersing machine]/[Rate (L/min) of a liquid treated per unit time]

An average residence time is a value obtained by dividing the space volume of the pre-dispersing machine by an average value of the rate of the liquid treated per unit time. The rate of the liquid treated is calculated out by dividing a feed rate (kg/min) of the liquid mixture by a density of the liquid mixture. In Examples of the present invention, the density of the liquid mixture is determined to be 0.9 (kg/L).

The residence time is controlled within the above range, whereby the preliminary dispersion of the colorant can be sufficiently and efficiently conducted.

The preliminary dispersion of the liquid mixture containing the polymerizable monomer and the colorant is preferably conducted by, for example, utilizing the preliminary dispersion system illustrated in FIG. 1 and circulating the liquid mixture at least twice in the pre-dispersing machine. The number of circulations can be calculated out in accordance with the following equation.

The number of circulations θ (times)=[Treatment time (min)]/[Time *t* (min/time) required for one circulation]

The time t required for one circulation is determined in accordance with the following equation.

$$t=W/V$$

wherein t: the time (min/time) required for one circulation,

W: the amount (kg) of the liquid mixture poured into the holding tank,

V: the flow rate (kg/min) of the liquid mixture to be treated.

The number of circulations in the preliminary dispersion step may be suitably selected according to the size of the pre-dispersing machine used, the kind of the colorant, the volume of the liquid mixture, and the like. However, the number of circulations is preferably from 2 to 20 times.

The peripheral velocity of the tip part of the agitating blade (rotor) of the pre-dispersing machine is generally from 15 to 60 m/s, preferably from 17 to 55 m/s, more preferably from 20 to 50 m/s. If the peripheral velocity of the agitating blade exceeds the upper limit of the above range, cavitation may occur to become hard to apply shearing force to the colorant, and so sufficient dispersion may not be attained. If the peripheral velocity of the agitating blade is lower than the lower limit of the above range, the shearing force may not be sufficiently gained.

When the preliminary dispersion is conducted by the pre-dispersing machine, it is desirable to conduct the preliminary dispersion while suppressing a range of temperature rise from a liquid temperature prior to the preliminary dispersion to the liquid temperature after the preliminary dispersion to preferably 30° C. or lower, more preferably 15° C. or lower by forced cooling for the purpose of preventing the temperature (liquid temperature) of the liquid mixture from being raised by heat generated by shearing. A jacket may be provided on not only the holding tank 101, but also the circulation lines 107, 112 to conduct cooling.

When the preliminary dispersion is conducted in the present invention, it is preferable to operate the pre-dispersing machine with the internal pressure thereof raised for the purpose of preventing cavitation by high-speed agitation. As described above, the shearing force applied to the colorant is lowered when the cavitation occurs, so that the dispersing efficiency is worsened. As a means for raising the internal pressure of the pre-dispersing machine, for example, like the system shown in FIG. 1, the internal pressure of the pre-dispersing machine 109 can be controlled by regulating the valve 111 located on the discharge side of the pre-dispersing machine 109 in the circulation line 112. The internal pressure of the pre-dispersing machine is controlled within a range of preferably from 0.01 to 15 MPa, more preferably from 0.05 to 10 MPa, particularly preferably from 0.1 to 5 MPa.

3. Dispersion Step

<First Invention>

The dispersion step using the media dispersing machine in Preparation Step 1 of the polymerizable monomer composition will hereinafter be described. In the first invention of the present application, the preliminarily dispersed polymerizable monomer liquid mixture obtained in the preliminary dispersion step A1 and containing the preliminarily dispersed colorant and the polymerizable monomer is fed to a media dispersing machine having a media-separating screen to more finely disperse the colorant.

Figure 2:
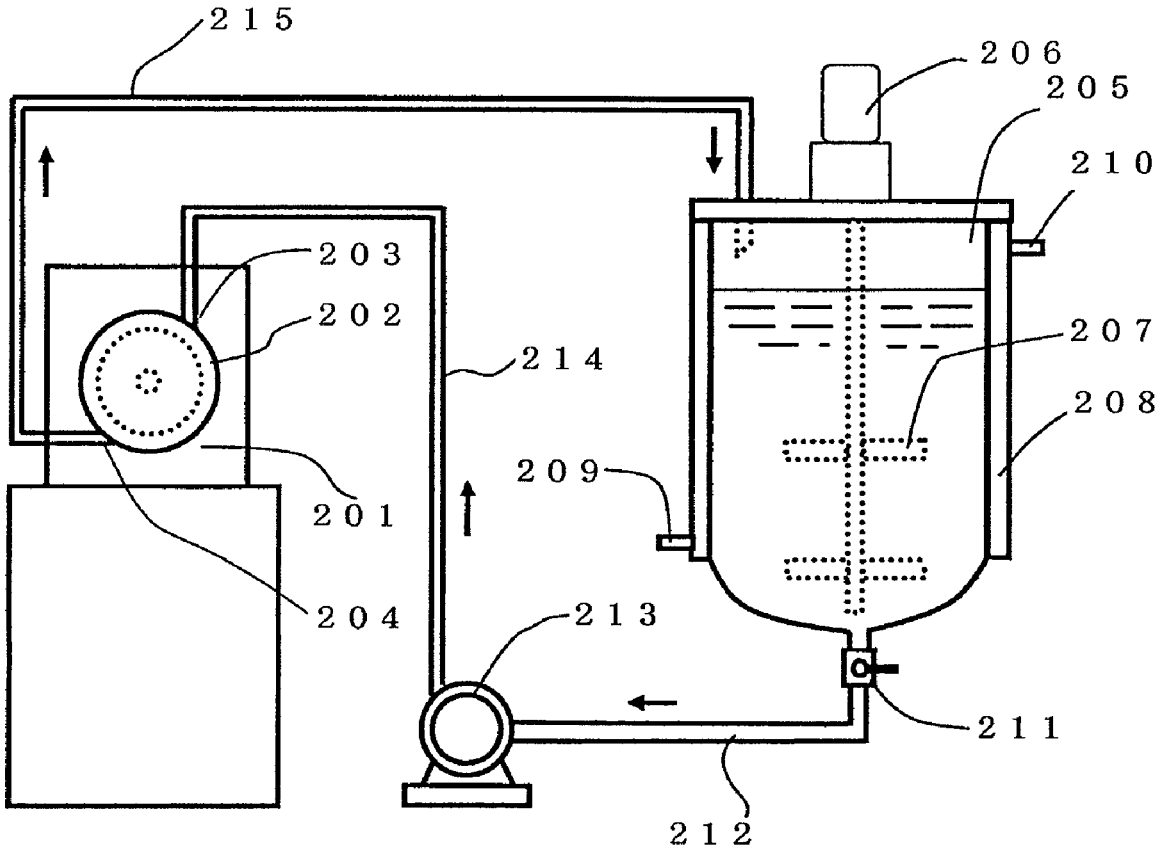
FIG. 2 illustrates a dispersion system adopted in Examples of the present invention.

In the dispersion step A2 of the present invention, a media dispersing machine equipped with a media-separating screen is used. An exemplary dispersion system using the media dispersing machine is illustrated in FIG. 2. The dispersion system shown in FIG. 2 has a structure that a media dispersing machine 201 and a holding tank 205 are connected to each other by a downward flow composed of lines 212 and 214 and an upward flow composed of a line 215. The holding tank 101 used in the preliminary dispersion step A1 may be used as the holding tank 205, and any other holding tank may also be used.

Agitating blades 207 driven and rotated by an agitating motor 206 are arranged in the holding tank 205. A jacket 208 is fitted to an outer wall of the holding tank 205 in such a manner that the temperature of the liquid in the holding tank 205 can be controlled to a desired temperature by introducing a temperature control medium into the jacket from an inlet 209 for the temperature control medium and discharging the medium from an outlet 210 for the temperature control medium.

A liquid mixture containing the polymerizable monomer and the colorant is poured into the holding tank 205 and agitated. As the liquid mixture, is used a dispersion liquid containing the colorant preliminarily dispersed in the preliminary dispersion step A1. The liquid mixture within the holding tank 205 is introduced into a casing (also referred to as "container" or "stator") 202 from a liquid supply port 203 of the media dispersing machine 201 through a valve 211, the line 212, a circulating pump 213 and the line 214 by driving the circulating pump 213.

The liquid mixture is subjected to strong shearing force within the media dispersing machine 201 to finely pulverize and disperse the colorant therein. The polymerizable monomer dispersion liquid with the colorant finely dispersed therein is introduced into the holding tank 205 from a liquid discharge port 204 through the line 215. The polymerizable monomer dispersion liquid passed through the media dispersing machine once may be circulated in the same media dispersing machine 201 again the desired number of times for the purpose of achieving more uniform and finer dispersion of the colorant.

The polymerizable monomer tends to initiate partial polymerization when it is heated to a high temperature. When the viscosity of the liquid mixture or dispersion is too high on the other hand, the flowability thereof in the dispersion system is lowered. It is thus desirable to make temperature control by passing a temperature control medium such as cold water or hot water through the jacket 208 in such a manner the temperature of the liquid in the holding tank 205 is controlled within a range of, for example, 30° C. or lower, preferably from 10 to 30° C.

Likewise, when the liquid mixture or dispersion is subjected to strong shearing force within the media dispersing machine, the temperature of the liquid mixture or dispersion is raised, and the polymerizable monomer tends to undergo partial polymerization. It is thus desirable to control the temperature of the liquid mixture within a range of about from 10 to 30° C. by passing a cooling medium such as cooling water through a jacket of the media dispersing machine.

Figure 3:
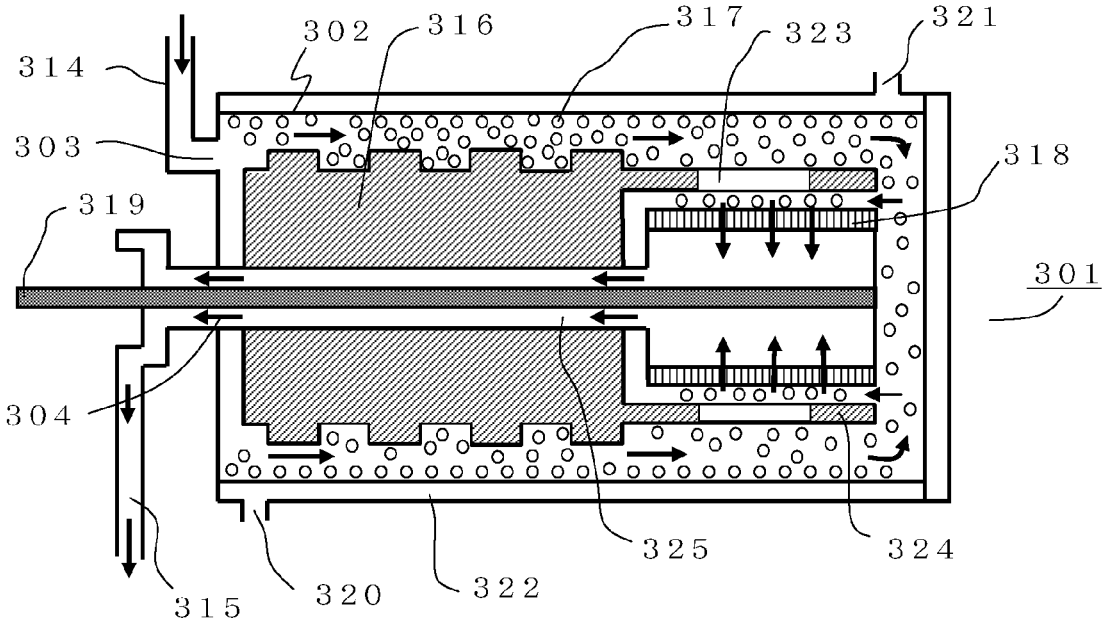
FIG. 3 is a cross-sectional view of an exemplary media dispersing machine used in the present invention.

FIG. 3 is a cross-sectional view illustrating the specific media dispersing machine used in the present invention. This media dispersing machine 301 has a structure that a driving shaft 319, and a rotor 316 and a media-separating screen 318, which are arranged on the driving shaft 319 and can be rotated simultaneously in cooperation with the rotation of the driving shaft 319, are arranged within a casing 302 having a liquid supply port 303 and a liquid discharge port 304.

An internal space defined between an inner wall of the casing 302 and an outer wall of the rotor 316 serves as a dispersing chamber containing media particles 317. At one end of the rotor 316, is provided a cylindrical part 324 in which a plurality of media particle-discharging slits 323 are formed. The media-separating screen 318 is arranged within this cylindrical part 324. A liquid introduced into the casing 302 from the liquid supply port 303 is passed through the media-separating screen 318 and discharged outside from the liquid discharge port 304 through a liquid discharge path 325. The liquid discharge path 325 is provided, for example, between the driving shaft 319 and the rotor 316. The liquid discharge path 325 may also be formed in the rotor 316.

When the driving shaft 319 is rotated by a motor (not illustrated) installed in this media dispersing machine, the rotor 316 and media-separating screen 318 arranged on the driving shaft 319 are rotated at the same time. The liquid mixture containing the polymerizable monomer and the colorant is continuously fed into the casing 302 through the liquid supply port 303 from a line 314, strong shearing force is applied to the liquid mixture by centrifugal force generated by the rotation of the rotor 316 and the action of the media particles 317, whereby the colorant is finely dispersed in the polymerizable monomer.

The polymerizable monomer dispersion liquid with the colorant finely dispersed therein is passed through the media-separating screen 318 and discharged outside from the liquid discharge port 304 through the liquid discharge path 325. When this polymerizable monomer dispersion liquid is returned back to the holding tank 205 through a line 315 and circulated in the same media dispersing machine again, a dispersion liquid with the colorant more uniformly and finely dispersed therein can be obtained.

In the dispersion system shown in FIG. 2, the circulating pump 213 is driven to continuously feed the liquid mixture or dispersion to the media dispersing machine, so that the polymerizable monomer dispersion liquid with the colorant finely dispersed therein is passed through the media-separating screen 318 and continuously discharged from the liquid discharge port 304 to the outside (for example, the interior of the holding tank) by discharge pressure of the circulating pump 213. The media-separating screen 318 is equipped with a lattice- or mesh-like screen. Since the media particles 317 used are greater than the mesh size or lattice space of the media-separating screen 318, they do not pass through the media-separating screen.

Figure 4:
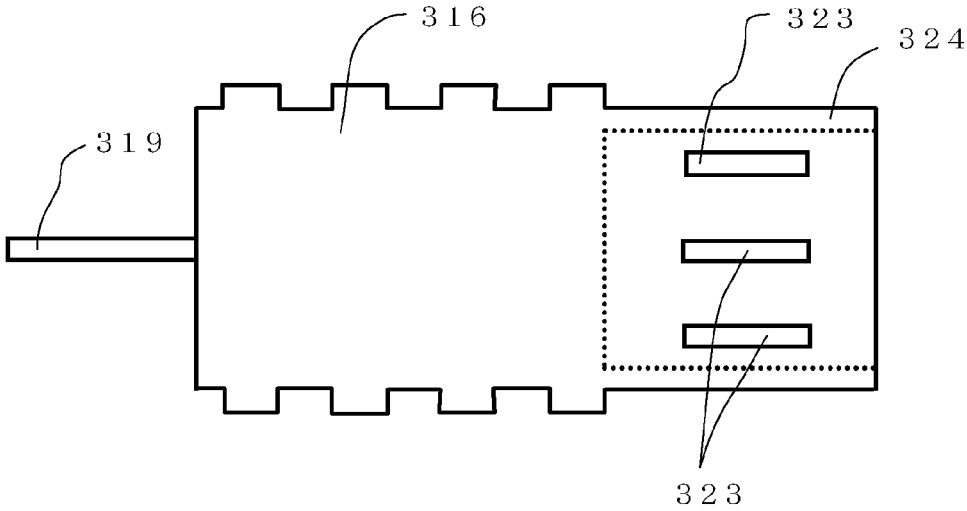
FIG. 4 illustrates a rotor used in the media dispersing machine.
Figure 5:
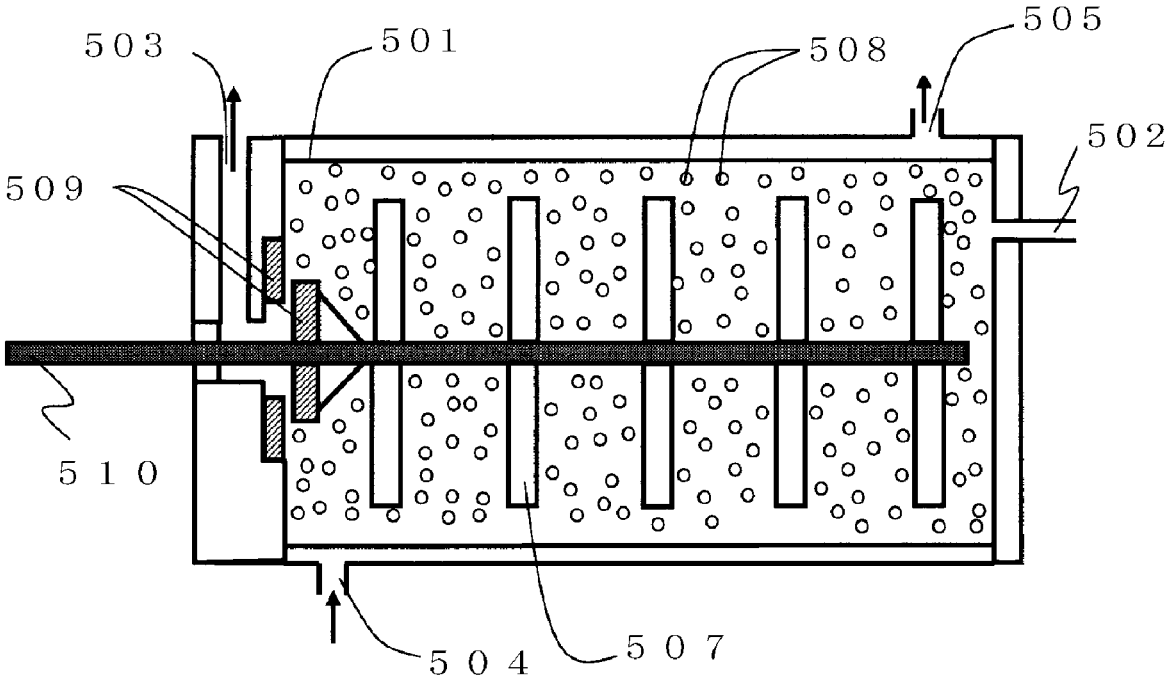
FIG. 5 is a cross-sectional view of an exemplary conventional media dispersing machine.

Since the media-separating screen is arranged on the driving shaft 319 and rotated in cooperation with the rotation of the driving shaft 319, the overall shape thereof is generally cylindrical. In other words, the outer periphery of the cylinder is formed by a screen, one end of the cylinder is closed, and an opening communicating with the liquid discharge path 325 is formed at the other end. As illustrated in FIGS. 3 and 4, the rotor 316 is provided with the cylindrical part 324, in which a plurality of media particle-discharging slits 323 are formed, at one end thereof. The media-separating screen is arranged within this cylindrical part.

The size of each slit 323 is regulated to such an extent that the media particles can be passed through. During the dispersing treatment, the polymerizable monomer dispersion liquid with the colorant finely dispersed therein reaches the surface of the media-separating screen 318 together with the media particles 317, the media particles 317 are returned to the dispersing chamber through the slits 323 formed in the cylindrical part 324 of the rotor 316 by virtue of the centrifugal force of the media-separating screen rotated, and only the polymerizable monomer dispersion liquid is discharged outside from the liquid discharge port 304.

Accordingly, this media dispersing machine can prevent uneven distribution such as remaining of the media particles 317 on the surface of the media-separating screen 318. In other words, the media dispersing machine is excellent in media-separating ability in the media-separating part to prevent the media-separating part from causing clogging during the dispersing treatment to raise the internal pressure. When the internal pressure of the media dispersing machine is raised during the dispersing treatment, it is necessary to stop its operation or relax operation conditions. Since this media dispersing machine is excellent in media-separating ability, however, the operation can be efficiently conducted to prevent the dispersing efficiency from lowering.

The media dispersing machine used in the present invention is preferably composed of a material having a Rockwell scale C hardness (HRC) of 20 or higher at portions of the rotor and casing, with which the liquid mixture or dispersion comes into contact. The Rockwell scale C hardness (HRC) is determined to be 20 or higher, whereby abrasion caused by sliding friction between the rotor and casing, and the media particles 317 contained in the internal space can be prevented, and in turn, the polymerizable monomer dispersion liquid can be prevented from being contaminated with contaminants produced by the abrasion.

The peripheral velocity of the tip of the rotor in the media dispersing machine is preferably at least 2 m/sec, more preferably at least 4 m/sec, particularly preferably at least 8 m/sec. The peripheral velocity is made high, whereby the dispersion of the colorant can be efficiently performed in a short period of time.

The rotor may be formed from, for example, a high-hardness ceramic such as zircon or zirconia, a high-hardness metal such as stainless steel, or a polymeric material such as ultra-high-molecular weight polyethylene or nylon.

The media particles may be formed from, for example, a high-hardness ceramic such as zircon or zirconia, or a high-hardness metal such as stainless steel. The media particles are generally spherical particles. The particle size (diameter) of the media particles is controlled to preferably 2 mm or smaller, more preferably 1 mm or smaller from the viewpoint of the dispersibility of the colorant in the polymerizable monomer. The particle size of the media particles is preferably from 0.03 to 0.5 mm, more preferably from 0.03 to 0.3 mm, particularly preferably from 0.03 to 0.2 mm from the viewpoint of the fine dispersibility of the colorant. The lower limit of the particle size of the media particles is more preferably about 0.05 mm.

The apparent filling factor of the media particles packed in the media dispersing machine is preferably from 60 to 95% by volume, more preferably from 70 to 90% by volume based on the internal space of the casing. The filling factor of the media particles is enhanced, whereby the colorant can be pulverized and dispersed with good efficiency to prevent short pass of the liquid mixture or dispersion in the dispersing chamber.

Among additive components for toner, a colorant such as a pigment is a component most difficult to be finely pulverized and dispersed, and other additive components such as a parting agent and a charge control agent are relatively easy to be dispersed or dissolved in the polymerizable monomer. Therefore, it is preferable from the viewpoint of the efficiency of the dispersing treatment to subject the liquid mixture composed of the polymerizable monomer and the colorant to the dispersing treatment using the media dispersing machine after the preliminary dispersion and cause the other additive components to be contained after completion of the dispersion step.

In other words, when the dispersing treatment is conducted with the liquid mixture composed substantially of the polymerizable monomer and the colorant without adding other additive components than the colorant, the colorant can be finely dispersed with good efficiency in a short period of time by means of a pre-dispersing machine and a holding tank each having a relatively small capacity, and a relatively small-sized media dispersing machine.

In the dispersion step, it is preferable to pulverize and disperse the colorant in the polymerizable monomer as finely as possible. The degree of dispersion of the colorant can be evaluated by using the particle diameter of the colorant particles and the glossiness of a coating film formed of the dispersion liquid as indices.

In the dispersion step, it is desirable to finely disperse the colorant until the number of colorant particles having a length exceeding 0.5 μm is preferably at most 10, more preferably at most 5, often 0.

More specifically, in the dispersion step, the degree of dispersion of the colorant by the media dispersing machine can be controlled in such a manner that when a coating film formed with a polymerizable monomer dispersion liquid with the colorant finely dispersed at a concentration of 3% by weight is observed through a light microscope of 400 magnifications, the number of colorant particles having a length exceeding 0.5 μm, which are contained in a visual field of a 100 μm square in the coating film, is preferably at most 10, more preferably at most 5, still more preferably at most 3, particularly preferably 0. As a method for adjusting the concentration of the colorant in the polymerizable monomer dispersion liquid to 3% by weight, it may be adopted to dilute the dispersion liquid sample with the polymerizable monomer or volatilize out the polymerizable monomer.

When the dispersion is conducted by means of the media dispersing machine, the dispersing treatment is generally conducted by feeding the liquid mixture within the holding tank 205 into the media dispersing machine 201. In order to achieve the sufficient degree of dispersion of the colorant, it is preferable that the liquid dispersion subjected to the dispersing treatment once be fed to the media dispersing machine again and circulated at least twice to conduct the dispersing treatment. The number (θ) of circulations can be calculated out in accordance with the following equation.

The number of circulations θ=[Treatment time (min)]/[Time (min/time) required for one circulation]

The time (t) required for one circulation is determined in accordance with the following equation.

$$t=W/V$$

wherein t: the time (min/time) required for one circulation,

W: the amount (kg) of the liquid mixture poured into the holding tank,

V: the rate (kg/min) of the liquid fed by the circulating pump.

The number of circulations in the dispersion step can be suitably selected according to the size of the media dispersing machine used, the kind of the colorant, the volume of the liquid to be treated, and the like. However, the number of circulations is of the order of preferably from 2 to 30 times, more preferably from 3 to 20 times, particularly preferably from 4 to 15 times.

In the present invention, a treating rate in the media dispersing machine means the rate (kg/min) of the liquid fed by the circulating pump. Specifically, this rate (kg/min) of the liquid mixture fed by the circulating pump means a feed rate (kg/min) of the liquid mixture from the holding tank 205 to the media dispersing machine 201.

In the present invention, the residence time of the liquid mixture in the media dispersing machine can be calculated out in accordance with the following equation.

Residence time (min)=[Space volume (L) of the media dispersing machine]/[Rate (L/min) of the liquid treated per unit time]

An average residence time is a value obtained by dividing the space volume of the media dispersing machine by an average value of the rate of the liquid treated per unit time. The rate of the liquid treated is calculated out by dividing a feed rate (kg/min) of the liquid mixture by a density of the liquid mixture. In Examples of the present invention, the density of the liquid mixture is determined to be 0.9 (kg/L). In the first invention of the present application, the residence time of the liquid mixture in the media dispersing machine may be set to preferably from 0.4 to 1.5 minutes.

<Second Invention>

In the second invention of the present application, Step 1 of preparing a polymerizable monomer composition containing at least a polymerizable monomer and a colorant comprises a dispersion step of finely dispersing the colorant in a liquid mixture containing the polymerizable monomer and the colorant. Further, in the dispersion step, the liquid mixture containing the polymerizable monomer and the colorant is poured into a holding tank joined to a media dispersing machine through a circulation line, and the liquid mixture is continuously fed to the media dispersing machine from the holding tank to circulate the liquid mixture in the media dispersing machine, thereby finely dispersing the colorant in the liquid mixture.

At this time, the amount of the liquid mixture fed to the media dispersing machine is controlled in such a manner that an average residence time $\tau 1$ within the media dispersing machine from the beginning of the dispersion step by the media dispersing machine to a half of the number of circulations in the whole dispersion step and an average residence time $\tau 2$ within the media dispersing machine from the half of the number of circulations in the whole dispersion step to the end of the whole dispersion step satisfy the relationship of $\tau 1/\tau 2>1.05$.

The liquid mixture fed to the media dispersing machine is a liquid mixture containing a colorant, which has a volume average particle diameter Dv smaller than 20 μm, and in which the volume percentage D51 of particles having a particle diameter of 51 μm or larger is lower than 20%. The volume average particle diameter Dv of the colorant in the liquid mixture is more preferably 19 μm or smaller, still more preferably 18 μm or smaller. The D51 of the colorant in the liquid mixture is more preferably 19% or lower, still more preferably 18% or lower. When the particle diameter of the colorant that is a starting material is too large, or the content of coarse particles contained therein is too high, the colorant is preferably preliminarily dispersed by the above-described preliminary dispersion step.

As the media dispersing machine, is preferred a media dispersing machine equipped with a media-separating screen. As the media dispersing machine, is more preferably used a media dispersing machine having a structure that a driving shaft, and a rotor and a media-separating screen, which are arranged on the driving shaft and can be rotated simultaneously in cooperation with the rotation of the driving shaft, are arranged within a casing having a liquid supply port and a liquid discharge port. In the dispersion step, the dispersion system shown in FIG. 2 may be utilized.

Both average residence times $\tau 1$ and $\tau 2$ of the liquid mixture within the media dispersing machine are preferably selected from a range of from 0.1 to 2.5 minutes and satisfy the relationship of $\tau 1/\tau 2>1.05$. The residence time can be calculated out in accordance with the above-described equation.

As another system than the circulation system illustrated in FIG. 2, may also be used a system by a pass system that a liquid mixture subjected to dispersion by the media dispersing machine is not returned to the original holding tank, but introduced into another tank.

In the dispersion step, dispersion is conducted in such a manner that when an average residence time of the first half of the dispersion step, i.e., from the beginning of the dispersion step to a half of the number of circulations in the whole dispersion step is regarded as an average residence time $\tau 1$, and an average residence time of the latter half of the dispersion step, i.e., from the half of the number of circulations in the whole dispersion step to the end of the whole dispersion step is regarded as an average residence time $\tau 2$, a ratio $\tau 1/\tau 2$ of from $\tau 1$ to $\tau 2$ satisfies the relationship of $\tau 1/\tau 2>1.05$.

The time required for the whole dispersion step is represented by "the whole residence time" that is a total residence time in the whole dispersion step. The whole residence time is calculated by the multiplication of a residence time per circulation.

As described above, $\tau 1/\tau 2$ is greater than 1.05, preferably greater than 1.07, more preferably greater than 1.10, particularly preferably greater than 1.20. When the dispersion in the dispersion step is conducted within this range, the colorant is uniformly and extremely finely dispersed in the polymerizable monomer with good efficiency.

The dispersing treatment is preferably conducted in such a manner that when an average residence time from the beginning of the dispersion step to a fourth of the number of circulations in the whole dispersion step is regarded as a, and an average residence time from the first one fourth of the number of circulations in the whole dispersion step to the end of the whole dispersion step is regarded as b, a ratio a/b satisfies the relationship of preferably a/b>1.1, more preferably a/b>1.2. When the dispersion is conducted within this range, the colorant is uniformly and extremely finely dispersed in the polymerizable monomer with good efficiency, whereby the dispersion can be more stably and efficiently performed.

The average residence time in the dispersion step can be suitably selected according to the size of the media dispersing machine used, the kind of the colorant, the amount of the liquid monomer mixture to be treated, and the like. However, the average residence time is preferably from 0.1 to 2.5 minutes, more preferably from 0.1 to 2.0 minutes, still more preferably from 0.1 to 1.7 minutes, particularly preferably from 0.1 to 1.5 minutes.

The number of circulations in the dispersion step can be suitably selected according to the size of the media type dispersing machine used, the kind of the colorant, the amount of the liquid monomer mixture to be treated, and the like. However, the number of circulations is of the order of preferably from 1 to 30 times, more preferably from 2 to 30 times, still more preferably from 2 to 20 times, particularly preferably from 3 to 15 times.

The number $\theta$ of circulations can be calculated out in accordance with the following equation. The fact that the number of circulations is 1 means that the liquid mixture is fed by a poured amount to the media type dispersing machine. Even in the case of the above-described pass system, the number of circulations is calculated out in accordance with the following equation.

The number of circulations $\theta$ (times)=[Treatment time (min)]/[Time $t$ (min/time) required for one circulation]

The time (t) required for one circulation is determined in accordance with the equation, $$t=W/V,$$

wherein

W: the amount (L) of the liquid polymerizable monomer mixture poured,

V: the rate (L/min) of the liquid treated per unit time.

The peripheral velocity of the tip of the rotor in the media dispersing machine is preferably at least 2 m/sec, more preferably at least 4 m/sec, particularly preferably at least 8 m/sec. The peripheral velocity is made high, whereby the dispersion of the colorant can be efficiently performed in a short period of time.

The media dispersing machine used in the second invention of the present application is a dispersing machine having a structure that a rotor is rotatably arranged within a stator, and media are filled into a space defined between the stator and the rotor and moved by the rotated rotor. Media dispersing machines include types of, for example, horizontal cylinder system, vertical cylinder system and inverse triangle system according to the form of a stator and the manner of arrangement thereof. As specific examples of trade names of commercially available products of the media dispersing machines, may be mentioned ATTRITOR (manufactured by Mitsui Miike Engineering Corporation), MAITI MILL (manufactured by INOUE MFG., INC.), DIAMOND FINE MILL (manufactured by Mitsubishi Heavy Industries, Ltd.), DYNO MILL (manufactured by Shinmaru Enterprises Corporation), PICO MILL (manufactured by Asada Iron Works Co., Ltd.), STAR MILL (manufactured by Ashizawa Finetech Ltd.) and APEX MILL (manufactured by Kotobuki Engineering & Manufacturing Co., Ltd.).

Among the above-described types, the dispersing machine of the horizontal cylinder system is preferred because good dispersion can be achieved while controlling changes in viscosity. A media dispersing machine having a media-separating screen is more preferably used because it has good media-separating ability. There is still more preferably used a media dispersing machine (see FIG. 3) so constructed that a driving shaft, and a rotor and a media-separating screen, which are arranged on the driving shaft and can be rotated simultaneously in cooperation with the rotation of the driving shaft, are arranged within a cylindrical casing, a cylindrical part, in which a plurality of media particle-discharging slits are formed, is provided at one end of the rotor, the media-separating screen is arranged within this cylindrical part, and a liquid introduced into the casing from a liquid supply port is passed through the media-separating screen and discharged from a liquid discharge port, and has a characteristic media-separating screen with media particles contained in an internal space defined between the inner surface of the casing and the outer surface of the rotor.

4. Formation Step 2 of Colored Polymer Particles

The processes according to the present invention for producing a polymerized toner comprise Step 2 of polymerizing the polymerizable monomer composition prepared in Step 1 with a polymerization initiator to form colored polymer particles. In Step 2, a polymerization process such as a suspension polymerization process, dispersion polymerization process or emulsion polymerization process, in which the polymerizable monomer composition is polymerized in an aqueous dispersion medium, is adopted. Among these processes, the suspension polymerization process and emulsion polymerization process are preferred, with the suspension polymerization process being more preferred.

The suspension polymerization process comprises a step of polymerizing a polymerizable monomer composition containing at least a colorant and a polymerizable monomer in an aqueous dispersion medium. As the aqueous dispersion medium, is generally used an aqueous dispersion medium containing a dispersion stabilizer. In the suspension polymerization process, the polymerizable monomer composition is first suspended in the aqueous dispersion medium containing the dispersion stabilizer to form fine droplets, and suspension polymerization is then conducted to form colored polymer particles. As needed, a step of additionally polymerizing a polymerizable monomer for shell in the presence of the colored polymer particles may be added to form core-shell type colored polymer particles.

Accordingly, the production processes according to the present invention comprise a step of polymerizing the polymerizable monomer composition containing at least the colorant and polymerizable monomer in the aqueous dispersion medium in Step 2 to form colored polymer particles, and if desired, additionally polymerizing a polymerizable monomer for shell in the presence of the colored polymer particles to form core-shell type colored polymer particles, thereby preparing an aqueous dispersion containing the colored polymer particles or core-shell type colored polymer particles.

In the emulsion polymerization process, may be adopted a process in which the polymerizable monomer composition containing the polymerizable monomer and colorant is first emulsion-polymerized in an aqueous dispersion medium containing an emulsifier, and the resultant colored fine resin particles are then aggregated and enlarged to a particle diameter suitable for toner.

Water such as ion-exchanged water is generally used as the aqueous dispersion medium. However, that obtained by adding a hydrophilic solvent such as alcohol to water may also be used. In the suspension polymerization process, the dispersion stabilizer is contained in the aqueous dispersion medium to increase the stability of droplets of the polymerizable monomer composition dispersed in the aqueous dispersion medium.

In the suspension polymerization process, a dispersion stabilizer such as colloid of a hardly water-soluble metal hydroxide is used. However, a surfactant may also be used in combination. In the emulsion polymerization process, various kinds of emulsifiers are added to the aqueous dispersion medium for the purpose of stabilizing the dispersion of the polymerizable monomer or polymerizable monomer composition.

Among these polymerization processes, the suspension polymerization process is preferred in that spherical colored polymer particles having a desired particle diameter are easy to be obtained, and core-shell type colored polymer particles are easy to be formed. Thus, the suspension polymerization process will hereinafter be mainly described.

The dispersion stabilizer used in the present invention is preferably colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly water-soluble metal hydroxides are preferred because the particle diameter distribution of polymer particles to be formed can be narrowed to improve the brightness of an image to be formed.

The colloid of the hardly water-soluble metallic compound is not limited by the production process thereof. However, colloid of a hardly water-soluble metal hydroxide obtained by adjusting the pH of an aqueous solution of a water-soluble polyvalent metallic compound to 7 or higher is preferred, and colloid of a hardly water-soluble metal hydroxide formed by reacting a water-soluble polyvalent metallic compound with an alkali metal hydroxide salt in an aqueous phase is particularly preferred. The colloid of the hardly water-soluble metallic compound preferably has number particle diameter distributions, $D_{50}$ (50% cumulative value of number particle diameter distribution) of at most 0.5 μm and $D_{90}$ (90% cumulative value of number particle diameter distribution) of at most 1 μm.

The dispersion stabilizer is used in a proportion of generally from 0.1 to 20 parts by weight per 100 parts by weight of the polymerizable monomer. If this proportion is too low, it is difficult to achieve sufficient polymerization stability, so that polymer aggregates are liable to be formed. If this proportion is too high, the viscosity of the aqueous solution becomes too high, and the polymerization stability is lowered.

In the present invention, a water-soluble polymer may be used as a dispersion stabilizer. As examples of the water-soluble polymer, may be mentioned polyvinyl alcohol, methyl cellulose and gelatin.

The above dispersion stabilizers may be used either singly or in any combination thereof.

In the present invention, there is no need to use a surfactant. However, the surfactant may be used within limits not increasing the dependency of charging properties of the resulting polymerized toner on environment for stably conducting the suspension polymerization.

The polymerized toner is composed of colored polymer particles in which a polymer formed by the polymerization of a polymerizable monomer becomes a binder resin, and additive components such as a colorant and a parting agent are dispersed therein. As needed, the colored polymer particles may be used as core particles, and a shell formed of a polymer layer may be formed on the core particles to provide core-shell type colored polymer particles.

Taking the suspension polymerization process as an example, the polymerized toner can be obtained in accordance with, for example, the following process. The polymerizable monomer composition is dispersed in the aqueous dispersion medium containing the dispersion stabilizer, and the resultant dispersion is stirred to form uniform droplets of the polymerizable monomer composition. In the formation of the droplets of the polymerizable monomer composition, primary droplets having a volume average particle diameter of about from 50 to 1,000 μm are first formed. In order to avoid premature polymerization, a polymerization initiator is preferably added to the aqueous dispersion medium after the size of the droplets in the aqueous dispersion medium becomes uniform.

The polymerization initiator is added and mixed into the suspension with the primary droplets of the polymerizable monomer composition dispersed in the aqueous dispersion medium, and the resultant mixture is stirred by means of a high-speed shearing type agitator until the droplet diameter of the droplets becomes a small diameter near to the intended particle diameter of the colored polymer particles. In such a manner, fine secondary droplets generally having a volume average droplet diameter of about from 1 to 12 μm are formed.

The suspension containing the secondary droplets of the polymerizable monomer composition is charged into a polymerization reactor to conduct suspension polymerization at a temperature of generally from 5 to 120° C., preferably from 35 to 95° C., more preferably from 50 to 95° C. Since a polymerization initiator high in catalytic activity must be used if the polymerization temperature is too low, it is difficult to control the polymerization reaction. If the polymerization temperature is too high, and an additive melted at a low temperature is contained, this additive may bleed on the surface of the resulting polymerized toner to deteriorate the storage stability of the polymerized toner.

The volume average droplet diameter and droplet diameter distribution of the fine droplets of the polymerizable monomer composition affect the volume average particle diameter and particle diameter distribution of the resulting polymerized toner. If the droplet diameter of the droplets is too great, the particle diameter of the colored polymer particles to be formed becomes too great to lower the resolution of an image to be formed. If the droplet diameter distribution of the droplets is too wide, the fixing temperature of the resulting polymerized toner varies, so that inconveniences such as fogging and toner filming tend to occur. Accordingly, the secondary droplets of the polymerizable monomer composition are desirably formed so as to have almost the same volume average droplet diameter and droplet diameter distribution as those in the colored polymer particles to be formed.

The volume average droplet diameter of the droplets of the polymerizable monomer composition is generally from 1 to 15 μm, preferably from 2 to 12 μm, more preferably from 3 to 9 μm. When it is intended to provide a polymerized toner having a particularly small particle diameter for providing high-definition images, it is desirable to control the volume average droplet diameter of the droplets to preferably about from 2 to 9 μm, more preferably about from 3 to 8 μm, still more preferably about from 3 to 7 μm. The droplet diameter distribution (volume average droplet diameter/number average droplet diameter) of the droplets of the polymerizable monomer composition is generally from 1 to 3, preferably from 1 to 2.5, more preferably from 1 to 2. When particularly fine droplets are formed, it is preferable to pass an aqueous dispersion medium containing the polymerizable monomer composition through between a rotor rotated on its axis at a high speed and a stator surrounding it and having small openings or comb-like teeth.

As the polymerizable monomer, at least one is selected from among the above-mentioned monovinyl monomers. At this time, a polymerizable monomer or a combination of polymerizable monomers, which permits forming a polymer having a glass transition temperature Tg of the order of generally 80° C. or lower, preferably from 40 to 80° C., more preferably from 50 to 70° C., is preferably selected. In the present invention, the Tg of the polymer making up the binder resin is a calculated value, i.e., "calculated Tg", calculated out according to the kind(s) and proportion(s) of the polymerizable monomer(s) used.

The suspension polymerization forms colored polymer particles with the additive components such as the colorant dispersed in the polymer of the polymerizable monomer. In the present invention, the colored polymer particles are used as a polymerized toner. In order to improve the storage stability (i.e., "blocking resistance"), low-temperature fixing ability and melting ability upon fixing of the resulting polymerized toner, an additional polymer layer may be formed on the colored polymer particles obtained by the suspension polymerization to provide core-shell type colored polymer particles.

As a process for forming the core-shell type structure, may be adopted, for example, a process in which the above mentioned colored polymer particles are used as core particles, and a polymerizable monomer for shell is additionally polymerized in the presence of the core particles to form a polymer layer (shell) on each surface of the core particles.

When a monomer forming a polymer having a Tg higher than the Tg of the polymer component forming the core particles is used as the polymerizable monomer for shell, the storage stability of the resulting polymerized toner can be improved. On the other hand, the Tg of the polymer component forming the core particles is preset low, thereby permitting lowering the fixing temperature of the resulting polymerized toner and improving the melting properties. Accordingly, the colored polymer particles of the core-shell structure are formed in the polymerization step, thereby providing a polymerized toner capable of meeting speeding-up of printing, formation of full-color images and permeability through an overhead projector (OHP).

As polymerizable monomers for forming the core and shell, respective preferable monomers may be suitably selected from among the above-mentioned monovinyl monomers. A weight ratio of the polymerizable monomer for core to the polymerizable monomer for shell is generally from 40/60 to 99.9/0.1, preferably from 60/40 to 99.7/0.3, more preferably from 80/20 to 99.5/0.5. If the proportion of the polymerizable monomer for shell is too low, the effect of improving the storage stability of the resulting polymerized toner becomes little. If the proportion is too high on the other hand, the effect of lowering the fixing temperature of the resulting polymerized toner becomes little.

The Tg of the polymer formed from the polymerizable monomer for shell is generally higher than 50° C., but not higher than 120° C., preferably higher than 60° C., but not higher than 110° C., more preferably higher than 80° C., but not higher than 105° C. A difference in Tg between the polymer formed from the polymerizable monomer for core and the polymer formed from the polymerizable monomer for shell is preferably at least 10° C., more preferably at least 20° C., particularly preferably at least 30° C. In many cases, a monomer capable of forming a polymer having a Tg of generally at most 60° C., preferably from 40 to 60° C. is preferably selected as the polymerizable monomer for core from the viewpoint of a balance between fixing temperature and storage stability. On the other hand, as the polymerizable monomer for shell, monomers capable of forming a polymer having a Tg higher than 80° C., such as styrene and methyl methacrylate, may be preferably used either singly or in combination of two or more monomers thereof.

The polymerizable monomer for shell is preferably added to the polymerization reaction system as droplets having a droplet diameter smaller than the average particle diameter of the core particles. If the droplet diameter of the droplets of the polymerizable monomer for shell is too great, it is difficult to uniformly form the polymer layer about the core particles. In order to form the polymerizable monomer for shell into fine droplets, it is only necessary to subject a mixture of the polymerizable monomer for shell and an aqueous dispersion medium to a finely dispersing treatment by means of, for example, an ultrasonic emulsifier and add the resultant dispersion liquid to the polymerization reaction system.

When the polymerizable monomer for shell is a relatively water-soluble monomer (for example, methyl methacrylate) having a solubility of at least 0.1% by weight in water at 20° C., the monomer tends to relatively quickly migrate into the surfaces of the core particles, so that there is no need to conduct the finely dispersing treatment. However, it is preferable to conduct the finely dispersing treatment from the viewpoint of forming a uniform shell. On the other hand, when the polymerizable monomer for shell is a monomer (for example, styrene) having a solubility lower than 0.1% by weight in water at 20° C., it is preferable that the monomer be made liable to migrate into the surfaces of the core particles by conducting the finely dispersing treatment or adding an organic solvent (for example, an alcohol) having a solubility of at least 5% by weight in water at 20° C. to the reaction system.

A charge control agent may be added to the polymerizable monomer for shell if desired. As the charge control agent, may preferably be used the same charge control agent as that used in the production of the core particles. When the charge control agent is used, it is used in a proportion of generally from 0.01 to 10 parts by weight, preferably from 0.1 to 5 parts by weight per 100 parts by weight of the polymerizable monomer for shell.

In order to produce the colored polymer particles of the core-shell structure, the polymerizable monomer for shell or an aqueous dispersion thereof is added to the suspension containing the core particles in one lot, or continuously or intermittently. It is preferable from the viewpoint of efficient formation of the shell to add a water-soluble radical initiator at the time the polymerizable monomer for shell is added. It is considered that when the water-soluble polymerization initiator is added, the water-soluble initiator enters in the vicinity of each surface of the core particles to which the polymerizable monomer for shell has migrated, so that the polymer layer is easy to be formed on the core particle surfaces.

As examples of the water-soluble polymerization initiator, may be mentioned persulfates such as potassium persulfate and ammonium persulfate; and azo initiators such as 2,2'-azobis[2-methyl-N-(2-hydroxyethyl)propionamide] and 2,2'-azobis-[2-methyl-N-[1,1-bis(hydroxymethyl)ethyl]-propionamide. The proportion of the water-soluble polymerization initiator used is generally from 0.1 to 50 parts by weight, preferably from 1 to 20 parts by weight per 100 parts by weight of the polymerizable monomer for shell.

The average thickness of the shell is generally from 0.001 to 1.0 μm, preferably from 0.003 to 0.5 μm, more preferably from 0.005 to 0.2 μm. If the thickness of the shell is too great, the fixing ability of the resulting polymerized toner is deteriorated. If the thickness is too small, the storage stability of the resulting polymerized toner is deteriorated.

The particle diameters of the core particles and the thickness of the shell in the polymerized toner can be determined by directly measuring the size and shell thickness of each of particles selected at random from electron photomicrographs thereof when they can be observed through an electron microscope. If the core and shell in each particle are difficult to be observed through the electron microscope, the thickness of the shell can be calculated out from the particle diameter of the core particle and the amount of the polymerizable monomer used for forming the shell.

5. Washing and Recovering Step

After the step of forming the colored polymer particles, the colored polymer particles are recovered from the aqueous dispersion medium. A step of removing volatile organic compounds such as unreacted polymerizable monomer(s) may be arranged prior to the recovery. A specific example thereof, may be adopted a process in which the aqueous dispersion containing the colored polymer particles is subjected to a stripping treatment to remove volatile organic compounds.

A washing step is arranged after the step of forming the colored polymer particles, or such a step of removing the volatile organic compounds as described above. In other words, the recovery of the colored polymer particles is conducted by dehydrating, washing, filtering and drying treatments in accordance with a method known per se in the art, whereby dry colored polymer particles are recovered. Prior to the dehydration, for example, a treatment such as acid washing or alkali washing according to the kind of the dispersion stabilizer used is generally performed for the purpose of solubilizing and removing the dispersion stabilizer.

For example, when colloid of a hardly water-soluble metal hydroxide, such as magnesium hydroxide colloid, is used as a dispersion stabilizer, an acid such as sulfuric acid is added to the aqueous dispersion to solubilize the dispersion stabilizer in water (this process being referred to as "acid washing"). The pH of the aqueous dispersion is adjusted to preferably 5 or lower by the acid washing.

After the acid washing or alkali washing, the aqueous dispersion is filtered and dehydrated. After the dehydration, the colored polymer particles are washed with wash water. It is preferable from the viewpoint of enhancing washing efficiency to conduct the feed of wash water and dehydration repeatedly or continuously. Therefore, a dehydrating and washing machine is preferably used to conduct washing with water. Examples of the dehydrating and washing machine include a continuous belt filter and a siphon peeler type centrifuge.

After the washing step, the colored polymer particles in the wetted state are dried. Drying methods include fluidized drying, vacuum drying and the like. However, vacuum drying capable of drying at a low temperature is preferred, with drying by a vacuum dryer equipped with a agitating blade being particularly preferred.

6. Polymerized Toner and Developer

The volume average particle diameter Dv of the polymerized toner obtained as the colored polymer particles (including colored polymer particles of the core-shell type) by one of the production processes according to the present invention is generally from 2 to 15 μm, preferably from 3 to 15 μm, more preferably from 4 to 12 μm. When resolution is enhanced to provide a high-definition image, it is particularly desirable that the volume average particle diameter of the polymerized toner be made small to preferably from 2 to 9 μm, more preferably from 3 to 8 μm. If the volume average particle diameter is too small, the flowability of the resulting polymerized toner is lowered, and so its transferability may be lowered, blur may occur, or the printing density may be lowered. If the volume average particle diameter is too great, the resolution of an image formed with such a toner may be deteriorated in some cases.

A ratio Dv/Dp (particle diameter distribution) of the volume average particle diameter Dv to the number average particle diameter Dp of the colored polymer particles making up the polymerized toner according to the present invention is preferably at most 1.5, more preferably from 1.0 to 1.4, still more preferably from 1.0 to 1.3, particularly preferably from 1.0 to 1.25. If the Dv/Dp is too high, the resulting polymerized toner may tend to causes blur or lower transferability, printing density and resolution. The volume average particle diameter and number average particle diameter of the colored polymer particles can be measured by means of a MULTISIZER (manufactured by Beckmann Coulter, Inc.).

The spheroidicity Sc/Sr of the colored polymer particles making up the polymerized toner according to the present invention is preferably from 1.0 to 1.3, more preferably from 1.0 to 1.2. If the spheroidicity Sc/Sr is too high, the transferability and flowability of the toner may be lowered, and the toner may tend to causes blur in some cases. The spheroidicity Sc/Sr of the colored polymer particles is determined in the following manner. The colored polymer particles are photographed by an electron microscope, and the resultant photograph is processed by means of an image processing analyzer, LUZEX IID (manufactured by NIRECO Corporation) under conditions of an area rate of particles to a frame area of 2% in maximum and a total processing number of 100 particles. The thus-obtained spheroidicities Sc/Sr of 100 colored polymer particles are averaged to find an average spheroidicity.

$$\text{Spheroidicity}=Sc/Sr$$

wherein

Sc: an area of a circle supposing that the absolute maximum length of a particle is a diameter, Sr: a substantial projected area of the colored polymer particle.

The polymerized toner obtained by one of the production processes according to the present invention may be used as a toner component for various kinds of developers. However, it is preferably used as a non-magnetic one-component developer.

When the polymerized toner according to the present invention is used as the non-magnetic one-component developer, an external additive may be mixed as needed.

Examples of the external additive include inorganic particles and organic resin particles functioning as a flowability improver, an abrasive and/or the like.

Examples of the inorganic particles include silicon dioxide (silica), aluminum oxide (alumina), titanium oxide, zinc oxide, tin oxide, barium titanate and strontium titanate.

Examples of the organic resin particles include particles of methacrylic ester polymers, acrylic ester polymers, styrene-methacrylic ester copolymers and styrene-acrylic ester copolymers, and core-shell type particles in which the core is composed of a styrene polymer, and the shell is composed of a methacrylic ester copolymer.

Among these, the inorganic oxide particles are preferred as the external additive, with silicon dioxide being particularly preferred. The surfaces of the inorganic fine particles may be subjected to a hydrophobicity-imparting treatment, and silicon dioxide particles subjected to the hydrophobicity-imparting treatment are particularly preferred.

Two or more of the external additives may be used in combination. When two or more external additives are used in combination, it is preferable to use two or more kinds of inorganic particles, which are different in average particle diameter from each other, or inorganic particles and organic resin particles in combination. No particular limitation is imposed on the proportion of the external additive used. However, it is generally from 0.1 to 6 parts by weight per 100 parts by weight of the polymerized toner. In order to attach the external additive to the polymerized toner, the polymerized toner and the external additive are generally charged into a mixer such as a HENSCHEL MIXER to stir them.

EXAMPLES

The present invention will hereinafter be described in more detail by the following examples and comparative examples. However, the present invention is not limited to the following examples only. All designations of "part" or "parts" and "%" mean part or parts by weight and % by weight unless expressly noted. Testing methods performed in EXAMPLES are as follows.

(1) Particle Diameter Measurement of Colorant

Each of a liquid polymerizable monomer mixture and a preliminarily dispersed liquid polymerizable monomer mixture each containing a polymerizable monomer and a colorant was diluted to 1/20 with a styrene solution (concentration of a charge control agent; 1%) of a charge control agent (styrene/acrylic resin, product of Fujikura Kasei Co., Ltd., trade name "FCA-207P") to prepare a sample for particle diameter measurement. The thus-obtained sample was used to measure a volume average particle diameter Dv of the colorant and a volume percentage D51 of particles having a particle diameter of 51 μm or larger contained therein by means of an SALD particle size distribution meter (manufactured by Shimadzu Corporation).

(2) Dispersibility of Colorant

A part of a polymerizable monomer dispersion liquid with a colorant dispersed therein was taken out as a sample, and it was diluted with a polymerizable monomer having the same composition to prepare a dispersion liquid containing the colorant at a concentration of 3% by weight. This dispersion liquid was applied on to a polyethylene terephthalate (PET) film by means of a doctor blade at a space of 30 μm and dried to form a coating film. This coating film was observed through a light microscope of 400 magnifications to count the number of colorant particles having a length exceeding 0.5 μm in a visual field of a 100 μm square.

(3) Printing Density:

A toner was placed in a commercially available printer of a non-magnetic one-component development system to conduct solid printing of a 50-mm square on paper for copying under an environment of 23° C. in temperature and 50% in humidity. At this time, a developing bias voltage was changed to change a developing rate M/A that is an amount of the toner on the paper for copying. The developing rate M/A was calculated out in accordance with the following equation by taking an unfixed image out of the printer and blowing off the toner on the paper for copying after development with air.

$$M/A(\text{mg/cm}^2)=(W_1-W_2)/25\ \text{cm}^2$$

wherein $W_1$=weight (mg) of the paper for copying before blowing off the toner, $W_2$=weight (mg) of the paper for copying after blowing off the toner.

A printing density of a solid-printed fixed image of a 5-mm square at the M/A of 0.45 mg/cm$^2$ was measured by means of a reflection type densitometer (manufactured by McBeth Co., model name "RD918").

Example 1

A tank 101 shown in FIG. 1 was charged with 80 parts by weight of styrene, 20 parts by weight of butyl acrylate, 5 parts of a magenta colorant (product of Fuji Pigment Co., Ltd., trade name "FUJI FAST CARMINE 528-1") obtained by mixing C.I. Pigment Red 31 and 150 with each other, and 0.25 part of an aluminum coupling agent (aluminum alkylacetoacetate diisopropylate; product of Ajinomoto Fine-Techno Co., Inc., trade name "AL-M"), and the mixture was stirred to prepare a liquid polymerizable monomer mixture.

Dv and D51 of the magenta colorant in this liquid polymerizable monomer mixture were measured and found to be Dv=70.7 μm and D51=68.4%.

This liquid polymerizable monomer mixture was preliminarily dispersed by means of an in-line type emulsifying and dispersing machine (manufactured by Ebara Corporation, trade name "MILDER") as a pre-dispersing machine under conditions that a peripheral velocity of the tip part of a rotor (agitating blade) is 23.6 m/s, and the number θ of circulations is 4 times, thereby obtaining a preliminarily dispersed liquid polymerizable monomer mixture. The temperature of the liquid mixture was controlled to 25° C. during the preliminarily dispersing treatment.

Dv and D51 of the colorant in this preliminarily dispersed liquid polymerizable monomer mixture were measured and found to be Dv=12.8 μm and D51=13.0%.

The dispersing step of the preliminarily dispersed liquid polymerizable monomer mixture obtained by the preliminary dispersion was carried out in the following manner by means of the dispersion system shown in FIG. 2 making use of the media dispersing machine equipped with a media-separating screen shown in FIG. 3.

Space volume of casing: 5.47 liters,

Media particles: zirconia beads 0.1 mm in diameter,

Amount of media particles filled: 4.65 liters (85% of the space volume of the casing), Slit width in media-separating screen: 53 μm, and Number of revolutions of driving shaft: 865 rpm (peripheral velocity of rotor tip: 12 m/sec).

The preliminarily dispersed liquid polymerizable monomer mixture obtained in the preliminarily dispersing step was poured into the holding tank 205. At this time, the temperature of the liquid mixture in the holding tank 205 was controlled to 25° C. by introducing a temperature control medium (hot water or cold water) into the jacket 208 from the inlet 209 for the temperature control medium and discharging the medium from the outlet 210 for the temperature control medium.

This preliminarily dispersed liquid polymerizable monomer mixture was continuously fed into the media dispersing machine 201 at a feed rate of 9.2 kg/min from the holding tank 205 using the circulating pump 213. When the preliminarily dispersed liquid polymerizable monomer mixture was continuously fed, strong shearing force was caused to act on the liquid mixture by centrifugal force generated by rotation of the rotor 316 and the vigorously moving media particles 317 to mill the magenta colorant finely. The preliminarily dispersed liquid polymerizable monomer mixture with the magenta colorant finely dispersed therein is separated from the media particles 317 by the media-separating screen 318 and discharged outside from the liquid discharge port 304 through the liquid discharge path 325. The preliminarily dispersed liquid polymerizable monomer mixture discharged from the liquid discharge port 304 is returned to the holding tank 205 through the line 215. The preliminarily dispersed liquid polymerizable monomer mixture with the magenta colorant finely dispersed therein, which has been returned to the holding tank 205, is continuously fed again into the media dispersing machine 201 through the lines 212 and 214. In such a manner, the liquid mixture was subjected to dispersing treatment while being circulated through the media dispersing machine.

During the dispersing treatment, the media particles 317 transferred in the vicinity of the surface of the media-separating screen 318 are returned to the dispersing chamber through the media particle-discharging slits 323 in the cylindrical part 324 provided at one end of the rotor 316 by the centrifugal effect between the rotated rotor 316 and the media-separating screen 318, thereby preventing the media particles from remaining on the surface of the media-separating screen 318. Accordingly, the pressure within the casing 302 was stably kept at 0.05 Mpa during the dispersing treatment. Cooling water was fed into a jacket 322 from a cooling medium inlet 320 and discharged from a cooling medium outlet 321 to make temperature control in such a manner that the temperature of the preliminarily dispersed liquid polymerizable monomer mixture with the magenta colorant finely dispersed therein, which is discharged from the liquid discharge port 304, is kept to 25° C. during the operation.

The dispersing treatment was conducted for 60 minutes until the number θ of circulations reached 10 times, and the operation was stopped. The treating rate of the dispersion liquid was 9.2 kg/min. The residence time τ (min) of the dispersion liquid within the media dispersing machine was 5.47 (L)/9.2 (kg/min)×0.9 (kg/L)=0.54 minutes.

The dispersibility of the colorant in the dispersion liquid obtained in the dispersion step was determined. As a result, the number of colorant particles having a length exceeding 0.5 μm was 0.

To 100.25 parts of the polymerizable monomer dispersion liquid with the magenta colorant finely dispersed therein, were then added 1 part of a charge control agent (styrene/acrylic resin, product of Fujikura Kasei Co., Ltd., trade name "FCA-207P"), 0.25 part of a polymethacrylic ester macromonomer (product of Toagosei Chemical Industry Co., Ltd., trade name "AA6"), 10 parts of dipentaerythritol hexamyristate, 1.75 parts of t-dodecyl-mercaptan as a molecular weight modifier and 0.25 part of divinylbenzene as a crosslinkable monomer, and the resultant mixture was stirred into a solution to prepare a polymerizable monomer composition.

On the other hand, an aqueous solution with 5 parts of sodium hydroxide (alkali metal hydroxide) dissolved in 50 parts of ion-exchanged water was gradually added under stirring to an aqueous solution with 6.5 parts of magnesium chloride (water-soluble polyvalent metal salt) dissolved in 250 parts of ion-exchanged water to prepare an aqueous dispersion medium containing magnesium hydroxide colloid (colloid of hardly water-soluble metal hydroxide).

After the polymerizable monomer composition was poured into the aqueous dispersion medium prepared above, and the resultant mixture was stirred, 5 parts of t-butyl peroxy-2-ethylhexanoate (product of Nippon Oil & Fats Co., Ltd., trade name "PERBUTYL 0") as a polymerization initiator was further poured, and the mixture was stirred for 10 minutes at 15,000 rpm under high shearing force by means of an in-line type emulsifying and dispersing machine (manufactured by Ebara Corporation, trade name "MILDER") to form droplets of the polymerizable monomer composition.

The aqueous dispersion with the droplets of the polymerizable monomer composition dispersed therein was poured into a reactor equipped with an agitating blade to initiate a polymerization reaction at 90° C. After a conversion into a polymer reached almost 100%, 1 part of methyl methacrylate as a polymerizable monomer for shell and 0.1 part of 2,2'-azobis[2-methyl-N-[1,1-bis(hydroxy-methyl)-2-hydroxy-ethyl]propionamide] (product of Wako Pure Chemical Industries, Ltd., trade name "VA086") dissolved in 10 parts of ion-exchanged water were added while keeping the polymerization temperature intact to continue the reaction for 3 hours at 90° C. Thereafter, the reaction was stopped to obtain an aqueous dispersion containing core-shell type colored polymer particles. The pH of the aqueous dispersion was 9.5.

While stirring the above-obtained aqueous dispersion containing the colored polymer particles, the pH of the aqueous dispersion was adjusted to 6 or lower with sulfuric acid, and stirring was continued at 25° C. for 10 minutes to conduct acid washing. After water was then separated by filtration, 500 parts of ion-exchanged water was newly added to form a slurry, and the slurry was stirred for 10 minutes and washed with water. After filtration, dehydration and water washing were repeated several times, colored polymer particles were separated by filtration to obtain wet colored polymer particles. The wet colored polymer particles were placed in a container of a vacuum dryer and vacuum-dried at a temperature of 50° C. under a pressure of 30 Torr.

The particle diameter distribution of the colored polymer particles after the drying were such that the volume average particle diameter Dv was 6.46 μm, the number average particle diameter Dp was 5.39 μm, the volume percentage of particles having a particle diameter of 16 μm or larger was 0.91%, the volume percentage of particles having a particle diameter of 20 μm or larger was 1.3%, and the number percentage of particles having a particle diameter of 5 μm or smaller was 39.8%.

Into 100 parts of the colored polymer particles obtained above were added 2 parts of fine silica particles subjected to a hydrophobicity-imparting treatment, and they were mixed by means of a HENSCHEL MIXER to prepare a non-magnetic one-component developer (toner). The results are shown in Table 1.

Comparative Example 1

A preliminarily dispersing step was conducted by changing the number θ of circulations in the preliminarily dispersing step in Example from 4 times to 3 times. In the dispersion step using the media dispersing machine, the preliminarily dispersed liquid mixture was continuously fed at a feed rate of 2 kg/min into the media dispersing machine 201 from the holding tank 205. The process was performed in the same manner as in Example 1 except for the above-described treatments. Dv and D51 of the colorant in the preliminarily dispersed liquid polymerizable monomer mixture were measured and found to be Dv=14.2 μm and D51=25.3%. In the dispersion step, great lowering of the treating rate was observed.

The dispersibility of the colorant in the dispersion liquid obtained in the dispersion step was determined. As a result, the number of colorant particles having a length exceeding 0.5 μm was 100 or more.

Comparative Example 2

The colorant in Example 1 was changed from the magenta colorant to a yellow colorant, C.I. Pigment Yellow 74, the amount of the colorant added was changed from 5 parts to 7 parts, and the dispersion step using the media dispersing machine was carried out without conducting the preliminarily dispersing step. Dv and D51 of the colorant in this liquid polymerizable monomer mixture were measured and found to be Dv=59.7 μm and D51=66.7%. The media-separating screen was clogged with aggregates of the colorant and the media particles during the dispersion step to close the screen, so that the dispersing treatment became impossible, and so the subsequent process was stopped.

Comparative Example 3

The same process was conducted in the same manner as in Comparative Example 2 except that a colorant obtained by classifying the yellow colorant in Comparative Example 2 by means of a classifier (manufactured by ALPINE Co., trade name "MULIPLET 100MZR") to lower the content of coarse particles was used. Dv and D51 of the colorant in this polymerizable monomer mixture were measured and found to be Dv=23.0 μm and D51=14.9%. In the dispersion step, great lowering of the treating rate was observed.

The dispersibility of the colorant in the dispersion liquid obtained in the dispersion step was determined. As a result, the number of colorant particles having a length exceeding 0.5 μm was 100 or more.

The results of Example 1 and Comparative Examples 1 to 3 are shown in Table 1.

TABLE 1

| | Ex. 1 | Comp. Ex. 1 | Comp. Ex. 2 | Comp. Ex. 3 |
|---|---|---|---|---|
| Pigment | Magenta | Magenta | Yellow | Yellow |
| Particle diameter of colorant | | | | |
| Polymerizable monomer mixture | | | | |
| DV [μm] | 70.7 | 70.7 | 59.7 | 23.0 |
| D51 [vol. %] | 68.4 | 68.4 | 66.7 | 14.9 |
| Preliminarily dispersed mixture | | | | |
| DV [μm] | 12.8 | 14.2 | — | — |
| D51 [vol. %] | 13.0 | 25.3 | — | — |
| Dispersion step by media type dispersing machine | | | | |
| Treating rate [kg/min] | 9.2 | 2.0 | — | 1.8 |
| Residence time τ [min] | 0.54 | 2.46 | — | 2.74 |
| Printing evaluation | | | | |
| Printing density | 1.37 | 1.10 | — | 1.08 |

Example 2

Into 80 parts by weight of styrene and 20 parts by weight of butyl acrylate, were mixed 6 parts of C.I.

Pigment Yellow 74 (product of Sanyo Color Works, Ltd., trade name "FAST YELLOW 7415") and 1 part of C.I. Pigment Yellow 74 (product of Sanyo Color Works, Ltd., trade name "FAST YELLOW 7416") to prepare a liquid polymerizable monomer mixture.

This liquid polymerizable monomer mixture was preliminarily dispersed by means of an in-line type emulsifying and dispersing machine (manufactured by Ebara Corporation, trade name "MILDER") as a pre-dispersing machine under conditions that a peripheral velocity of the tip part of a rotor (agitating blade) is 23 m/s, and the number θ of circulations is 6 times, thereby obtaining a preliminarily dispersed liquid polymerizable monomer mixture. Dv and D51 of the colorant in this preliminarily dispersed liquid polymerizable monomer mixture were measured and found to be Dv=16.4 μm and D51=17.6%. The temperature of the liquid mixture was controlled to 25° C. during the preliminarily dispersing treatment.

The dispersing step of the preliminarily dispersed liquid polymerizable monomer mixture obtained by the preliminary dispersion was carried out in the following manner by means of the dispersion system shown in FIG. 2, in which the media dispersing machine shown in FIG. 3 was arranged.

Space volume of casing: 5.47 L,

Media particles: zirconia beads 0.3 mm in diameter,

Amount of media particles filled: 4.65 L (85% of the space volume of the casing), Slit width in media-separating screen: 150 μm, and Number of revolutions of driving shaft: 710 rpm (peripheral velocity of rotor tip: 10 m/sec).

The preliminarily dispersed liquid polymerizable monomer mixture obtained in the preliminarily dispersing step was poured into the holding tank 205. At this time, the temperature of the liquid mixture in the holding tank 205 was controlled to 30° C. by introducing a temperature control medium (hot water or cold water) into the jacket 208 from the inlet 209 for the temperature control medium and discharging the medium from the outlet 210 for the temperature control medium.

This preliminarily dispersed liquid polymerizable monomer mixture was continuously fed into the media dispersing machine 201 at a feed rate, by which the residence time will become 0.98 minute, from the holding tank 205 using the circulating pump 213. When the preliminarily dispersed liquid polymerizable monomer mixture was continuously fed, strong shearing force was caused to act on the liquid mixture by centrifugal force generated by rotation of the rotor 316 and the vigorously moving media particles 317 to mill the yellow colorant finely. The preliminarily dispersed liquid polymerizable monomer mixture with the yellow colorant finely dispersed therein is separated from the media particles 317 by the media-separating screen 318 and discharged outside from the liquid discharge port 304 through the liquid discharge path 325. The preliminarily dispersed liquid polymerizable monomer mixture discharged from the liquid discharge port 304 is returned to the holding tank 205 through the line 315. The preliminarily dispersed liquid polymerizable monomer mixture with the yellow colorant finely dispersed therein, which has been returned to the holding tank 205, is continuously fed again into the media dispersing machine 201 through the lines 212 and 214. In such a manner, the liquid mixture was subjected to dispersing treatment while being circulated through the media dispersing machine.

During the dispersing treatment, the media particles 317 transferred in the vicinity of the surface of the media-separating screen 318 are returned to the dispersing chamber through the media particle-discharging slits 323 in the cylindrical part 324 provided at one end of the rotor 316 by the centrifugal effect between the rotated rotor 316 and the media-separating screen 318, thereby preventing the media particles from remaining on the surface of the media-separating screen 318. Accordingly, the pressure within the casing 302 was stably kept at 0.1 Mpa during the dispersing treatment. Cooling water was fed into a jacket 322 from a cooling medium inlet 320 and discharged from a cooling medium outlet 321 to make temperature control in such a manner that the temperature of the preliminarily dispersed liquid polymerizable monomer mixture with the yellow colorant finely dispersed therein, which is discharged from the liquid discharge port 304, is kept to 25° C. during the operation.

The preliminarily dispersed liquid polymerizable monomer mixture was fed to the media dispersing machine at the feed rate of 0.98 minute in terms of the residence time from the beginning of the dispersion step to one time in the number θ of circulations. On and after 2 times in the number θ of circulations, the treatment was conducted in the residence time of 0.62 minute, the dispersing treatment was continued until the number θ of circulations reached 4 times, and the operation was then stopped. The whole residence time was 2.84 minutes.

The dispersibility of the colorant in the dispersion liquid obtained in the dispersion step was determined. As a result, the number of colorant particles having a length exceeding 0.5 μm was 0.

To 107 parts of the polymerizable monomer dispersion liquid with the yellow colorant finely dispersed therein, were then added 1.5 parts of a charge control resin (product of Fujikura Kasei Co., Ltd., trade name "FCA-161P") as a charge control agent, 0.5 part of a polymethacrylic ester macromonomer (product of Toagosei Chemical Industry Co., Ltd., trade name "AA6"), 6 parts of dipentaerythritol hexamyristate, 1.0 part of t-dodecyl-mercaptan as a molecular weight modifier and 0.9 part of divinylbenzene as a crosslinkable monomer, and the resultant mixture was stirred into a solution to prepare a polymerizable monomer composition.

On the other hand, an aqueous solution with 5 parts of sodium hydroxide (alkali metal hydroxide) dissolved in 50 parts of ion-exchanged water was gradually added under stirring to an aqueous solution with 6.5 parts of magnesium chloride (water-soluble polyvalent metal salt) dissolved in 250 parts of ion-exchanged water to prepare an aqueous dispersion medium containing magnesium hydroxide colloid (colloid of hardly water-soluble metal hydroxide).

After the dispersed polymerizable monomer composition was poured into the aqueous dispersion medium prepared above, and the resultant mixture was stirred, 5 parts of t-butyl peroxy-2-ethylhexanoate (product of NOF Corporation, trade name "PERBUTYL O") as a polymerization initiator was further poured, and the mixture was stirred under high shearing force by means of an in-line type emulsifying and dispersing machine (manufactured by Pacific Machinery & Engineering Co., Ltd., trade name "CAVITRON") to form droplets of the dispersed polymerizable monomer composition.

The aqueous dispersion with the droplets of the dispersed polymerizable monomer composition dispersed therein was poured into a reactor equipped with an agitating blade to initiate a polymerization reaction at 90° C. After a conversion into a polymer reached almost 100%, 1 part of methyl methacrylate as a polymerizable monomer for shell and 0.1 part of 2,2'-azobis[2-methyl-N-[1,1-bis(hydroxymethyl)-2-hydroxyethyl]propionamide] (product of Wako Pure Chemical Industries, Ltd., trade name "VA086") dissolved in 10 parts of ion-exchanged water were added to continue the reaction for 3 hours at 90° C. Thereafter, the reaction was stopped to obtain an aqueous dispersion containing core-shell type colored polymer particles. The pH of the aqueous dispersion was 9.5.

While stirring the above-obtained aqueous dispersion containing the colored polymer particles, the pH of the aqueous dispersion was adjusted to 5.5 with sulfuric acid, and stirring was continued at 25° C. for 10 minutes to conduct acid washing. After water was then separated by filtration, 500 parts of ion-exchanged water was newly added to form a slurry, and the slurry was stirred for 10 minutes and washed with water. After filtration, dehydration and water washing were repeated several times, colored polymer particles were separated by filtration to obtain wet colored polymer particles. The wet colored polymer particles were placed in a container of a vacuum dryer and vacuum-dried at a temperature of 45° C. under a pressure of 30 Torr.

The particle diameter distribution of the colored polymer particles after the drying were such that the volume average particle diameter Dv was 6.87 μm, the number average particle diameter Dp was 5.86 μm, the volume percentage of particles having a particle diameter of 16 μm or larger was 1.01%, the volume percentage of particles having a particle diameter of 20 μm or larger was 0.60%, the number percentage of particles having a particle diameter of 5 μm or smaller was 26.62%, and the number percentage of particles having a particle diameter of 3 μm or smaller was 4.44%.

Into 100 parts of the colored polymer particles obtained above were added 2 parts of fine silica particles subjected to a hydrophobicity-imparting treatment, and they were mixed by means of a HENSCHEL MIXER to prepare a non-magnetic one-component developer (toner). The whole residence time was 2.84 minutes.

Example 3

A non-magnetic one-component developer (toner) was prepared in the same manner as in Example 2 except that the media particles used in the media dispersing machine were changed from the zirconia beads having a diameter of 0.3 mm in Example 2 to zirconia beads having a diameter of 0.1 mm, and the preliminarily dispersed liquid polymerizable monomer mixture was fed in a residence time of 0.77 minute to one time in the number of circulations and then in a residence time of 0.67 minute to 4 times in the number of circulations. The whole residence time was 2.78 minutes.

The dispersibility of the colorant in the dispersion liquid obtained in the dispersion step was determined. As a result, the number of colorant particles having a length exceeding 0.5 μm was 0.

Comparative Example 4

Dispersion was started by changing the residence time from 0.98 minute in Example 2 to 0.62 minute. At the time before the number of circulations reached one time, the dispersing machine was clogged with the preliminarily dispersed liquid polymerizable monomer mixture, so that the dispersing treatment became impossible, and so the subsequent process was stopped. The whole residence time was 0.62 minute.

Comparative Example 5

Dispersion in Example 2 was continuously performed to 3 times in the number of circulations while keeping the residence time intact in 0.98 minute. The whole residence time was 2.94 minutes and almost the same as in Example 2.

The dispersibility of the colorant in the dispersion liquid obtained in the dispersion step was determined. As a result, the number of colorant particles having a length exceeding 0.5 μm was 100 or more.

Comparative Example 6

The residence time in Example 2 was changed to 1.64 minutes to continuously conduct dispersion to 4 times in the number of circulations under those conditions. The whole residence time was 6.56 minutes.

The dispersibility of the colorant in the dispersion liquid obtained in the dispersion step was determined. As a result, the number of colorant particles having a length exceeding 0.5 μm was 100 or more.

The results of Examples 2 and 3 and Comparative Examples 4 to 6 are shown in Table 2.

TABLE 2

| | Ex. 2 | Ex. 3 | Comp. Ex. 4 | Comp. Ex. 5 | Comp. Ex. 6 |
|---|---|---|---|---|---|
| <Dispersion step conditions> Residence time during dispersion step (min) (Number θ of circulations) | | | | | |
| (0-1θ) | 0.98 | 0.77 | 0.62 | 0.98 | 1.64 |
| (1θ-2θ) | 0.62 | 0.67 | Stopped | 0.98 | 1.64 |
| (2θ-3θ) | 0.62 | 0.67 | — | 0.98 | 1.64 |
| (3θ-4θ) | 0.62 | 0.67 | — | — | 1.64 |
| Whole residence time (min) | 2.84 | 2.78 | 0.62 | 2.94 | 6.56 |
| Average residence time | | | | | |
| τ1 (min) First half of dispersion step | 0.80 | 0.72 | — | 0.98 | 1.64 |
| τ2 (min) Latter half of dispersion step | 0.62 | 0.67 | — | 0.98 | 1.64 |
| Average residence time (min) of the whole dispersion step | 0.71 | 0.71 | — | 0.98 | 1.64 |
| τ1/τ2 | 1.29 | 1.07 | — | 1.00 | 1.00 |
| Printing evaluation | | | | | |
| Printing density | 1.32 | 1.31 | 1.09 | 1.28 | 1.30 |

INDUSTRIAL APPLICABILITY

According to the present invention, polymerized toners excellent in printing density and color tone can be stably and efficiently produced. The polymerized toners obtained by the production processes of the present invention can be used as developers in image forming apparatus by an electrophotographic system, such as facsimiles, copying machines and printers.

The invention claimed is:

1. A process for producing a polymerized toner, comprising Step 1 of preparing a polymerizable monomer composition containing a polymerizable monomer and a colorant and Step 2 of polymerizing the polymerizable monomer composition with a polymerization initiator to form colored polymer particles, wherein, Step 1 comprises Step A of finely dispersing the colorant in a liquid mixture containing the polymerizable monomer and the colorant, and further wherein Step A comprises the following Steps A1 and A2:

(1) Step A1 of feeding a liquid mixture containing a polymerizable monomer and a colorant, which has a volume average particle diameter of 20 μm or larger and/or contains particles having a particle diameter of 51 μm or larger in a volume percentage of 20% or higher, to a dispersing machine by which mechanical shearing force is applied by rotation of an agitating blade to preliminarily disperse the colorant in such a manner that the volume average particle diameter of the colorant becomes smaller than 20 μm, and the volume percentage of the particles having a particle diameter of 51 μm or larger becomes lower than 20%; and (2) Step A2 of feeding the liquid mixture containing the polymerizable monomer and the colorant and preliminarily dispersed in Step A1 to a media dispersing machine equipped with a media-separating screen to more finely disperse the colorant in the liquid mixture, thereby preparing a polymerizable monomer dispersion liquid.

2. The production process according to claim 1, wherein in Step A1, the volume average particle diameter of the colorant in the liquid mixture fed to the dispersing machine is from 20 to 150 μm, and/or the volume percentage of the particles having a particle diameter of 51 μm or larger is from 20 to 95%.

3. The production process according to claim 1, wherein in Step A1, the colorant is preliminarily dispersed in such a manner that the volume average particle diameter of the colorant is from 1 to 19 μm, and the volume percentage of the particles having a particle diameter of 51 μm or larger is from 1 to 19%.

4. The production process according to claim 1, wherein in Step A1, the colorant is preliminarily dispersed in such a manner that the volume average particle diameter of the colorant is from 5 to 15 and the volume percentage of the particles having a particle diameter of 51 μm or larger is from 5 to 15%.

5. The production process according to claim 1, wherein in Step A1, the peripheral velocity of the tip part of the agitating blade is controlled to from 15 to 60 m/s to perform the preliminary dispersion.

6. The production process according to claim 1, wherein the media dispersing machine is a media dispersing machine of a structure that a driving shaft, and a rotor and a media-separating screen, which are arranged on the driving shaft and can be rotated simultaneously in cooperation with the rotation of the driving shaft, are arranged within a cylindrical casing having a liquid supply port and a liquid discharge port.

7. The production process according to claim 6, wherein the media dispersing machine is a media dispersing machine so constructed that a cylindrical part, in which a plurality of media particle-discharging slits are formed, is provided at one end of the rotor, the media-separating screen is arranged within the cylindrical part of the rotor, a liquid introduced into the cylindrical casing from the liquid supply port is passed through the media-separating screen and discharged outside from the liquid discharge port through the liquid discharge path, and that media particles are contained in an internal space defined between an inner wall of the cylindrical casing and an outer wall of the rotor.

8. The production process according to claim 6, wherein in Step A2, the liquid mixture containing the colorant preliminarily dispersed in Step A1 is continuously fed to the cylindrical casing from the liquid supply port while simultaneously rotating the rotor and the media-separating screen by rotation of the driving shaft to more finely disperse the colorant in the liquid mixture by centrifugal force generated by the rotation of the rotor and the media particles, and the polymerizable monomer dispersion liquid with the colorant finely dispersed therein is passed through the media-separating screen and discharged outside from the liquid discharge port.

9. The production process according to claim 1, wherein in Step A2, the degree of dispersion of the colorant by the media dispersing machine is controlled in such a manner that the number of colorant particles having a length exceeding 0.5 μm, which are contained in a 100 μm square of a coating film formed with the resultant polymerizable monomer dispersion liquid, the concentration of the colorant in which has been controlled to 3% by weight, is at most 10.

10. The production process according to claim 1, wherein in Step A2, the liquid mixture preliminarily dispersed in Step A1 and containing the polymerizable monomer and the colorant is poured into a holding tank joined to the media dispersing machine through a circulation line, and the liquid mixture is continuously fed from the holding tank to the media dispersing machine and circulated in the media dispersing machine in the number of circulations of at least 2 times.

11. The production process according to claim 1, wherein the particle diameter of the media particles contained in the media dispersing machine is from 0.03 to 0.5 mm.

12. The production process according to claim 1, wherein in Step A2, the residence time of the liquid mixture within the media dispersing machine is from 0.4 to 1.5 minutes.

13. The production process according to claim 1, wherein the liquid mixture containing the polymerizable monomer and the colorant further comprises a coupling agent as a pigment dispersant.

14. The production process according to claim 1, wherein Step 1 further comprises a step of dispersing or dissolving other additive components than the colorant in the polymerizable monomer dispersion liquid obtained in Step A.

15. A process for producing a polymerized toner, comprising Step 1 of preparing a polymerizable monomer composition containing a polymerizable monomer and a colorant and Step 2 of polymerizing the polymerizable monomer composition with a polymerization initiator to form colored polymer particles, wherein, Step 1 comprises a dispersion step of finely dispersing the colorant in a liquid mixture containing the polymerizable monomer and the colorant, and further wherein in the dispersion step, a liquid mixture containing a polymerizable monomer and a colorant, which has a volume average particle diameter smaller than 20 μm, and in which the volume percentage of particles having a particle diameter of 51 μm or larger is lower than 20%, is poured into a holding tank joined to a media dispersing machine through a circulation line, and the liquid mixture is continuously fed to the media dispersing machine from the holding tank to circulate the liquid mixture in the media dispersing machine, thereby finely dispersing the colorant in the liquid mixture, and at this time, the amount of the liquid mixture fed to the media dispersing machine is controlled in such a manner that an average residence time $\tau 1$ within the media dispersing machine from the beginning of the dispersion step by the media dispersing machine to a half of the number of circulations in the whole dispersion step and an average residence time $\tau 2$ within the media dispersing machine from the half of the number of circulations in the whole dispersion step to the end of the whole dispersion step satisfy the relationship of $\tau 1/\tau 2>1.05$.

16. The production process according to claim 15, wherein the media dispersing machine is a media dispersing machine equipped with a media-separating screen.

17. The production process according to claim 16, wherein the media dispersing machine is a media dispersing machine of a structure that a driving shaft, and a rotor and a media-separating screen, which are arranged on the driving shaft and can be rotated simultaneously in cooperation with the rotation of the driving shaft, are arranged within a cylindrical casing having a liquid supply port and a liquid discharge port.

18. The production process according to claim 15, wherein prior to the dispersion step by the media dispersing machine, is arranged a step of feeding a liquid mixture containing a polymerizable monomer and a colorant, which has a volume average particle diameter of 20 μm or larger and/or contains particles having a particle diameter of 51 μm or larger in a volume percentage of 20% or higher, to a dispersing machine by which mechanical shearing force is applied by rotation of an agitating blade to preliminarily disperse the colorant in the liquid mixture in such a manner that the volume average particle diameter of the colorant becomes smaller than 20 μm, and the volume percentage of the particles having a particle diameter of 51 μm or larger becomes lower than 20%.

19. The production process according to claim 15, wherein the liquid mixture is circulated in the media dispersing machine in the number of circulations of at least 2 times.

20. The production process according to claim 15, wherein both average residence times $\tau 1$ and $\tau 2$ of the liquid mixture within the media dispersing machine are from 0.1 to 2.5 minutes.

* * * * *